US007520592B2

(12) United States Patent
Higuchi et al.

(10) Patent No.: US 7,520,592 B2
(45) Date of Patent: Apr. 21, 2009

(54) ELECTROSTATIC ATTRACTION FLUID JET DEVICE

(75) Inventors: Kaoru Higuchi, Tenri (JP); Yasuo Nishi, Hino (JP); Kazuhiro Murata, Tsukuba (JP); Hiroshi Yokoyama, Tsukuba (JP)

(73) Assignees: Sharp Kabushiki Kaisha, Osaka (JP); Konica Minolta Holdings, Inc., Chiyoda-Ku (JP); National Institute of Advanced Industrial Science and Technology, Tokyo (JP)

( * ) Notice: Subject to any disclaimer, the term of this patent is extended or adjusted under 35 U.S.C. 154(b) by 209 days.

(21) Appl. No.: 10/529,244

(22) PCT Filed: Sep. 22, 2003

(86) PCT No.: PCT/JP03/12047

§ 371 (c)(1),
(2), (4) Date: Oct. 21, 2005

(87) PCT Pub. No.: WO2004/028812

PCT Pub. Date: Apr. 8, 2004

(65) Prior Publication Data

US 2006/0170753 A1 Aug. 3, 2006

(30) Foreign Application Priority Data

Sep. 24, 2002 (JP) ..... 2002-278201
Sep. 24, 2002 (JP) ..... 2002-278210
Sep. 24, 2002 (JP) ..... 2002-278212
Sep. 24, 2002 (JP) ..... 2002-278219

(51) Int. Cl.
*B41J 2/06* (2006.01)

(52) U.S. Cl. ..... 347/55
(58) Field of Classification Search ..... 347/54, 347/55
See application file for complete search history.

(56) References Cited

U.S. PATENT DOCUMENTS 6,328,426 B1 12/2001 Chahn et al.

(Continued)

FOREIGN PATENT DOCUMENTS

JP 04-059255 2/1992

(Continued)

OTHER PUBLICATIONS

Computer-translated translation of JP 2002-172787.*

(Continued)

*Primary Examiner*—Huan H Tran
(74) *Attorney, Agent, or Firm*—Edwards Angell Palmer & Dodge LLP

(57) ABSTRACT

An electrostatic attraction fluid jet device of the present invention is so arranged that a nozzle (4) is formed so as to correspond to a meniscus equivalent to a tip portion in the form of a taylor cone formed in a process of an electrostatic attraction of ink (2) as a conventional fluid. A diameter of an ink-ejecting hole (4*b*) of the nozzle (4) is set to be substantially the same as a diameter of the tip portion, which is about to be ejected, of the meniscus (14) of ink. Moreover, the diameter of the ink-ejecting hole (4*b*) of the nozzle (4) is set to be equal to or less than a droplet diameter of the ink (2) which has just been ejected. Therefore, it is possible to provide an electrostatic attraction fluid jet device which can realize a recording device which has high resolution, is safe and is highly versatile.

34 Claims, 20 Drawing Sheets

U.S. PATENT DOCUMENTS

| | | | |
|---|---|---|---|
| 6,382,771 | B1 | 5/2002 | Ikeda et al. |
| 2002/0063083 | A1 | 5/2002 | Yogi et al. |
| 2005/0116069 | A1 | 6/2005 | Murata |

FOREIGN PATENT DOCUMENTS

| | | |
|---|---|---|
| JP | 06-198891 | 7/1994 |
| JP | 08-238774 | 9/1996 |
| JP | 2000-127410 | 5/2000 |
| JP | 2001-038911 | 2/2001 |
| JP | 2001-232798 | 8/2001 |
| JP | 2001-239670 | 9/2001 |
| JP | 2002-172787 | 6/2002 |

OTHER PUBLICATIONS

Computer-translated translation of JP 06-198891.*

* cited by examiner

ELECTROSTATIC ATTRACTION FLUID JET DEVICE

REFERENCE TO PRIOR APPLICATIONS

This application is a national stage filing of international application number PCTIJP03/12047, which has an international filing date of Sep. 22, 2003 and a claimed priority date of Sep. 24, 2002 and which is incorporated herein by reference. The claimed priority date is based on Japanese Patent Application No. 2002-278201 (filed Sep. 24, 2002), 2002-278210 (filed Sep. 24, 2002), 2002-278212 (filed Sep. 24, 2002), and 2002-278219 (filed Sep. 24, 2002), which are incorporated herein by reference.

TECHNICAL FIELD

The present invention relates to an electrostatic attraction fluid jet device which ejects a fluid, such as ink, onto a target by electrostatically attracting the fluid by electrifying the fluid.

BACKGROUND ART

Generally, there exist various fluid jet methods by which a fluid, such as ink, is ejected onto a target (printing medium). Here, the following description explains an ink jet printing method in which the ink is used as the fluid.

As drop on demand ink jet printing methods, (i) a piezo printing method in which a piezoelectric phenomenon is utilized, (ii) a thermal printing method in which a film boiling phenomenon of ink is utilized, and (iii) an electrostatic attraction printing method in which an electrostatic phenomenon is utilized, etc are developed. Especially, in recent years, a high-resolution ink jet printing method is strongly demanded. In order to realize the high-resolution ink jet recording, it is indispensable to reduce the size of the ink droplet to be ejected.

Here, the movement of the ink droplet, which is ejected from the nozzle and lands on the printing medium, is expressed by a motion equation (Equation (1)).

$$\rho ink\cdot(4/3\cdot\pi d^3)\cdot dv/dt=-Cd\cdot(1/2\cdot\rho air\cdot v^2)\cdot(\pi\cdot d^{2/4}) \quad (1)$$

The above ρink is a volume density of ink, V is a volume of a droplet, v is a velocity of a droplet, Cd is a drag coefficient, ρair is an air density, and d is a radius of an ink droplet. Cd is expressed by Equation (2).

$$Cd=24/Re\cdot(1+3/16\cdot Re^{0.62}) \quad (2)$$

Re is a Reynolds number. Re is expressed by Equation (3).

$$Re=2\cdot d\cdot\rho ink\cdot v/\eta, \quad (3)$$

where η is an air viscosity.

The influence exercised by the radius of the droplet on the movement energy of the ink droplet of the left side of Equation (1) is greater than the influence exercised by the radius of the droplet on the viscous resistance of the air. On this account, when the velocity of the droplet is constant, the smaller the droplet becomes, the more quickly the velocity of the droplet decreases. As a result, the droplet may not be able to reach the printing medium separated in a predetermined distance. Even when the droplet reaches the printing medium, the positioning accuracy of the droplet is low.

In order to prevent these from occurring, it is necessary to increase an initial velocity of the ejected droplet, that is, it is necessary to increase an ejection energy per unit volume.

However, according to the conventional piezo ink jet head and the conventional thermal ink jet head, the following problems occur when the size of the ejected droplet is decreased, that is, when the ejection energy of the droplet per unit volume is increased. It was especially difficult to set the amount of the ejected droplet to be equal to or less than 1 pl, that is, difficult to set the diameter of the droplet to be equal to or less than Φ10 μm.

Problem (A): The ejection energy of the piezo ink jet head relates to the amount of displacement and a developed pressure of a piezoid to be driven. The amount of displacement of the piezoid inseparably relates to the amount of the ink ejected, that is, to the size of the ink droplet. In order to reduce the size of the droplet, it is necessary to reduce the amount of displacement. It is difficult to improve the ejection energy, per unit volume, of the ejected droplet.

Problem (B): The thermal ink jet head utilizes the film boiling phenomenon of ink. Pressure generated when bubbles are formed is physically limited. Moreover, the ejection energy is substantially determined by the area of a heating element. The area of the heating element is substantially in proportion to a volume of the bubble formed, that is, in proportion to the amount of ink ejected. On this account, by decreasing the size of the ink droplet, the volume of the bubble formed is decreased and the ejection energy is also decreased. Therefore, it is difficult to improve the ejection energy, per unit volume, of the ejected droplet of the ink.

Problem (C): In both the piezo printing method and the thermal printing method, how much the drive element (heating element) works relates closely to the amount of ink ejected. Therefore, in the case of ejecting extremely minute droplet, it is very difficult to suppress the variation of the size of the droplet.

Here, as a method for solving the above problems, a method of ejecting minute droplets by using the electrostatic attraction printing method has been developed.

In the electrostatic attraction printing method, a motion equation of the ink droplet ejected from the nozzle is expressed below as Equation (4).

$$\rho ink\cdot(4/3\cdot\pi\cdot d^3)\cdot dv/dt=q\cdot E-Cd\cdot(1/2\cdot\rho air\cdot v_2)\cdot(\pi\cdot d^{2/4}), \quad (4)$$

where q is the amount of electric charge of a droplet, and E is a peripheral electric field intensity.

According to Equation (4), in the electrostatic attraction printing method, the ejected droplet receives, in addition to the ejection energy, an electrostatic force while the droplet is flying. Therefore, it is possible to reduce the ejection energy per unit volume and possible to apply the method to the ejection of a minute droplet.

As an ink jet device using such an electrostatic attraction printing method (hereinafter referred to as "electrostatic attraction ink jet device"), Document 1 (Japanese Laid-Open Patent Publication No. 238774/1996 (Tokukaihei 8-238774, published on Sep. 17, 1996)) discloses an ink jet device in which an electrode for applying voltages is provided inside the nozzle. Moreover, Document 2 (Japanese Laid-Open Patent Publication No. 127410/2000 (Tokukai 2000-127410, published on May 9, 2000)) discloses an ink jet device which has a slit as a nozzle, is provided with a stylus electrode protruded from the nozzle, and ejects ink containing fine particles.

The following description explains the ink jet device disclosed in Document 1 in reference to FIG. 17. FIG. 17 is a schematic cross section of the ink jet device.

In FIG. 17, 101 is an ink ejection chamber, 102 is ink, 103 is an ink chamber, 104 is a nozzle hole, 105 is an ink tank, 106 is an ink supplying path, 107 is a rotating roller, 108 is a printing medium, 110 is a control element portion, and 111 is a process control section.

Further, 114 is an electrostatic field applying electrode portion which is provided on the ink chamber 103 side in the ink jet chamber 101, 115 is a counter electrode portion which is a metallic drum provided at the rotating roller 107, and 116 is a bias power supply portion for applying a negative voltage of thousands of volts to the counter electrode portion 115. 117 is a high voltage power supply portion for supplying a high voltage of hundreds of volts to the electrostatic field applying electrode portion 114, and 118 is a ground portion.

Here, between the electrostatic field applying electrode portion 114 and the counter electrode portion 115, the negative voltage of thousands of volts applied from the bias power supply portion 116 to the counter electrode portion 115 and a high voltage of hundreds of volts from the high voltage power supply portion 117 are superimposed. In this way, a superimposed electric field is generated. The ejection of the ink 102 ejected from the nozzle 104 is controlled by means of the superimposed electric field.

In addition, 119 is a projected meniscus which is formed at the nozzle hole 104 by the bias voltage of thousands of volts applied to the counter electrode portion 115.

The following description explains an operation of the electrostatic attraction ink jet device thus arranged.

First, the ink 102 passes through the ink supplying path 106 by the capillary phenomenon, and is transferred to the nozzle hole 104 which ejects the ink 102. At this time, the counter electrode portion 115, to which the printing medium 108 is mounted, is provided face to face with the nozzle hole 104.

The ink 102 reached the nozzle hole 104 forms the projected ink meniscus 119 by the bias voltage of thousands of volts applied to the counter electrode portion 115. A signal voltage of hundreds of volts is applied from the high voltage power supply portion 117 to the electrostatic field applying electrode portion 114 which is provided in the ink chamber 103. The signal voltage thus applied is superimposed on the voltage applied from the bias power supply portion 116 to the counter electrode portion 115. Then, by the superimposed electric field, the ink 102 is ejected onto the printing medium 108. As a result, a printed image is formed.

The following description explains movement of the meniscus, until the droplet is ejected, of the droplet of the ink jet device disclosed in Document 1 in reference to FIGS. 18(*a*) to 18(*c*).

As illustrated in FIG. 18(*a*), before a drive voltage is applied, a projected meniscus 119*a* is formed on the surface of the ink because of the balance between (i) the electrostatic force of the bias voltage applied to the ink and (ii) the surface tension energy of the ink.

As illustrated in FIG. 18(*b*), when the drive voltage is applied, the electric charge generated on the fluid surface starts to concentrate on the center of the fluid surface. As a result, a meniscus 119*b* is so formed that the center of the fluid surface is highly projected.

As illustrated in FIG. 18(*c*), when the drive voltage is continuously applied, the electric charge generated on the fluid surface further concentrates on the center of the fluid surface. This results in the formation of a meniscus 119*c* which is a semilunar shape called "taylor cone". When the electrostatic force of the electric charge concentrated on the top of the taylor cone exceeds the surface tension energy of the ink, a droplet is formed and ejected.

Next, the following description explains the ink jet device disclosed in Document 2 in reference to FIG. 19. FIG. 19 is a diagram illustrating a schematic arrangement of the ink jet device.

As illustrated in FIG. 19, a case of the present ink jet device contains (i), as an ink jet head, a line-shaped recording head 211 formed by using low dielectric materials (acrylic resin, ceramics, etc.), (ii) a counter electrode 210 which is made of metal or high dielectric materials and is provided face to face with an ink-ejecting opening of the recording head 211, (iii) an ink tank 212 for storing ink which is made by dispersing electrified pigment particles in nonconductive ink medium, (iv) ink circulating system (pumps 214*a* and 214*b*, pipings 215*a* and 215*b*) for circulating ink between the ink tank 212 and the recording head 211, (v) a pulse voltage generating device 213 which applies a pulse voltage, for ejecting an ink droplet which forms one pixel of a record image, to each ejection electrode 211*a*, (vi) a drive circuit (not illustrated) which controls the pulse voltage generating device 213 according to an image data, (vii) a printing medium feeding apparatus (not illustrated) which causes a printing medium A to pass through a space between the recording head 211 and the counter electrode 210, (viii) a controller (not illustrated) which controls the entire device, etc.

The ink circulating system is composed of (i) two pipings 215*a* and 215*b* each of which connects the recording head 211 with the ink tank 212 and (ii) two pumps 214*a* and 214*b* which are driven by the controller.

The ink circulating system is divided into (i) an ink supplying system which supplies ink to the recording head 211 and (ii) an ink collecting system which collects ink from the recording head 211.

In the ink supplying system, the ink is pumped up by the pump 214*a* from the ink tank 212, and the ink thus pumped up is delivered to the ink supplying portion of the recording head 211 through the piping 215*a*. Meanwhile, in the ink collecting system, the ink is pumped up by the pump 215*b* from the ink collecting portion of the recording head 211, and the ink thus pumped up is compulsorily collected to the ink tank 212 through the piping 215*b*.

Moreover, as illustrated in FIG. 20, the recording head 211 includes (i) an ink supplying portion 220*a* which spreads the ink, supplied from the piping 215*a* of the ink supplying system, so that the ink is spread to be as wide as a line, (ii) an ink flow path 221 which guides the ink, supplied from the ink supplying part 220*a*, so that the ink forms a mountain-shape, (iii) an ink collecting portion 220*b* which connects the ink flow path 221 with the piping 215*b* of the ink collecting system, (iv) a slit-shaped ink-ejecting opening 222 which is open to the counter electrode 210 at the mountaintop of the ink flow path 221 and has an appropriate width (approximately 0.2 mm), (v) a plurality of ejection electrodes 211*a* provided in the ink ejection opening 222 with a predetermined pitch (approximately 0.2 mm), and (vi) party walls 223 which are made of low dielectric materials (for example, ceramic) and are provided on both sides and an upper surface of each ejection electrode 211*a*.

Each of the ejection electrodes 211*a* is made of metals, such as copper, nickel, etc. On the surface of the ejection electrode 211*a*, a low dielectric film (for example, polyimide film), which excels in wettability, for preventing pigments from being adhered is formed. Moreover, the top of each ejection electrode 211*a* is formed like a triangular pyramid. Each ejection electrode 211*a* projects from the ink-ejecting opening 222 to the counter electrode 210 by an appropriate length (70 μm to 80 μm).

According to the controller, the above-described drive circuit (not illustrated) gives a control signal to the pulse voltage generating device 213 during a time corresponding to gradation data included in the image data. Then, the pulse voltage generating device 213 superimposes a pulse Vp, whose pulse top corresponds to the kind of the control signal, on the high voltage signal which is on the bias voltage Vb so as to output a pulse voltage thus superimposed.

When the image data is transferred, the controller drives two pumps 214*a* and 214*b* of the ink circulating system. Then, the ink is delivered from the ink supplying portion 220*a*, and the negative pressure is applied to the ink collecting portion 220*b*. The ink flowing in the ink flow path 211 passes through the gap between the party walls 223 by the capillary phenomena. Then, the ink spreads so as to reach the top of each ejection electrode 211*a*. At this time, the negative pressure is applied to the surface of each ink fluid near the top of the ejection electrode 211*a*. Therefore, the ink meniscus is formed on the top of each ejection electrode 211*a*.

Further, the controller controls the printing medium feed mechanism so that the printing medium A is fed in a predetermined direction. Moreover, by controlling the drive circuit, the high voltage signal is applied between the printing medium A and the ejection electrode 211*a*.

The following description explains the movement of the meniscus, until the droplet is ejected, of the droplet of the ink jet device disclosed in Document 2 in reference to FIGS. 21 to 24.

As illustrated in FIG. 21, when the pulse voltage generated by the pulse voltage generating device 213 is applied to the ejection electrode 211*a* in the recording head 211, an electric field, which goes from the ejection electrode 211*a* to the counter electrode 210, is generated. Here, because the ejection electrode 211*a* whose top is sharp is used, the strongest electric field is generated around the top of the ejection electrode 211*a*.

As illustrated in FIG. 22, when such an electric field is generated, each electrified pigment particle 201*a* in the ink solvent moves toward the surface of the ink fluid by the force fE (FIG. 23) exerted from the electric field. In this way, the density of pigment around the surface of the ink fluid is increased.

As illustrated in FIG. 23, when the density of pigment is thus increased, a plurality of electrified pigment particles 201*a* around the surface of the ink fluid starts to cohere at the opposite side of the electrode. Then, a pigment aggregate 201 starts to grow to form a spherical shape near the surface of the ink fluid. Then, the electrostatic repulsive force fcon from the pigment aggregate 201 starts to influence each electrified pigment particle 201*a*. That is, each electrified pigment particle 201*a* is influenced by the total force ftotal which is a resultant force of the electrostatic repulsive force fcon from the pigment aggregate 201 and the force fE from the electric field E generated by the pulse voltage.

Therefore, in the case in which the electrostatic repulsive force between the electrified pigment particles does not excess the force of cohesion of the electrified pigment particles, when the force fE exceeds the electrostatic repulsive force fcon ($fE \geqq fcon$), the electrified pigment particles 201*a* form the pigment aggregate 201. Note that, the force fE is applied from the electric field to the electrified pigment particle 201*a* (electrified pigment particle 201*a* which is located on a straight line between the top of the ejection electrode 211*a* and the center of the pigment aggregate 201) to which the total force ftotal in a direction of the pigment aggregate 201 is applied.

The pigment aggregate 201 formed by n pieces of electrified pigment particles 201*a* receives an electrostatic repulsive force FE from the electric field E generated by the pulse voltage, and also receives the binding force Fesc from the ink solvent. When the electrostatic repulsive force FE and the binding force Fesc are balanced, the pigment aggregate 201 becomes stable in a state in which the pigment aggregate 201 projects slightly from the surface of the ink fluid.

Further, as illustrated in FIGS. 24(*a*) to 24(*c*), when the pigment aggregate 201 grows and the electrostatic repulsive force FE exceeds the binding force Fesc, the pigment aggregate 201 is separated from the surface 200*a* of the ink fluid.

Incidentally, according to the principle of the conventional electrostatic attraction printing method, the meniscus is projected by concentrating the electric charge on the center of the meniscus. The curvature radius of a taylor cone tip portion thus projected is determined by the amount of concentrated electric charge. When the electrostatic force of the amount of concentrated electric charge and the electric field intensity exceeds the surface tension energy of the meniscus, the droplet starts to be ejected.

The maximum amount of electric charge of the meniscus is determined by the physical-property value of the ink and the curvature radius of the meniscus. Therefore, the minimum size of the droplet is determined by the physical-property value of the ink (especially, the surface tension energy) and the intensity of the electric field generated at the meniscus portion.

Generally, the surface tension energy tends to become lower in a fluid containing solvents than in a pure solution. Because typical ink contains various solvents, it is difficult to increase the surface tension energy. On this account, the ink surface tension energy is considered to be constant, and a method of decreasing the size of the droplet by increasing the electric field intensity is used.

Therefore, according to the principle of the ejection of the ink jet device disclosed in each of Documents 1 and 2, a field whose intensity is high is generated at the meniscus region whose area is much larger than a project area of the ejected droplet. By the field, the electric charge is concentrated on the center of the meniscus. Then, by an electrostatic force of the concentrated electric charge and the electric field, the ejection is carried out. Therefore, it is necessary to apply an extremely high voltage of about 2000 V. On this account, it is difficult to control the driving, and there is a problem in view of the safety of the operation of the ink jet device.

Especially, when the electric field whose intensity is high is generated in a large region, it is necessary to set the electric field intensity to be equal to or less than the intensity of the discharge breakdown (for example, the intensity of the discharge breakdown of the air between the parallel flat plates is $3\times10^6$ V/m). Therefore, the possible size of the minute droplet is fundamentally limited.

In addition, because the electric charge moves to the center of the meniscus portion, the amount of time for the electric charge to move influences the response of ejection. This causes a problem in the improvement of the print speed.

As is used in Documents 1 and 2, a method of solving these problems is (i) a method of reducing a drive voltage by applying a bias voltage which is lower than an ejection voltage, or (ii) an arrangement in which, as disclosed in Document 2, an electrode projects from a nozzle portion so that the concentration of electric charge is accelerated. Moreover, for example, as is disclosed in Document 1, a method of applying a positive voltage to ink in order to project a meniscus in ahead is also proposed.

However, both methods disclosed in Documents 1 and 2 cannot fundamentally solve the problems. Especially, when the bias voltage is applied, only one of positive and negative drive voltages can be applied. When the printing medium is made of an insulating material, the surface electric potential of the printing medium is increased by the adhesion of the electrified ejected droplet. Therefore, the positioning accuracy deteriorates. On this account, it is necessary to take countermeasures, such as eliminating, while printing, the surface potential of the printing medium.

Moreover, because the field whose intensity is high is generated at the meniscus region whose area is large, it is necessary to accurately position the counter electrode. In addition, because the dielectric constant and the thickness of the printing medium influence the positioning of the counter electrode, the degree of freedom is low when using printing mediums. Especially, when the printing medium is thick, the counter electrode has to be placed at a position remote from the electrode of the nozzle portion. On this account, it is necessary to apply a higher voltage. Moreover, many of printing mediums are difficult to be used practically.

Therefore, according to the conventional electrostatic attraction ink jet device (electrostatic attraction fluid jet device), there is a problem in that it is impossible to realize a recording device which has high resolution, is safe and is highly versatile.

The present invention was made to solve the above problems, and an object of the present invention is to provide an electrostatic attraction fluid jet device which can realize the recording device which has high resolution, is safe and is highly versatile.

DISCLOSURE OF INVENTION

The present inventors found that it is possible to decrease the size of the electric field which is conventionally large, and also possible to decrease the amount of movement of the electric charge at the meniscus 22 of a fluid. This can be realized by using a nozzle 23 whose nozzle diameter is shorter toward a fluid-ejecting hole so that the nozzle diameter is substantially equal in size to a curvature 24 of a tip portion, which is about to be ejected, of the meniscus 22 of a fluid whose shape is a taylor cone at a nozzle portion 21, the meniscus 22 being a meniscus of a droplet and being formed in the process of the electrostatic attraction.

The present inventors further found that, by utilizing the above principle, it is possible to equalize a region where the electric charge is concentrated and a meniscus region by setting the diameter of the fluid-ejecting hole of the tip portion of the nozzle so that the diameter of the fluid-ejecting hole is equal to or less than the diameter of the droplet which has just been ejected.

Therefore, in order to solve the above problems, the electrostatic attraction fluid jet device of the present invention ejects a fluid electrified by the voltage application, the fluid being ejected by electrostatically attracting the fluid as a droplet ejected from a fluid-ejecting hole of a nozzle made of insulating materials, wherein the diameter of the fluid-ejecting hole of the nozzle is equal to or less than a droplet diameter of the fluid which has just been ejected.

According to the above arrangement, it becomes possible to decrease the size of the electric field, which is conventionally large, by setting the nozzle diameter so that the nozzle diameter is substantially equal to the diameter of the tip portion, where the electric charge is concentrated, of the taylor cone formed for ejecting a fluid whose droplet diameter is shorter than the diameter of the fluid-ejecting hole of the conventional nozzle in the conventional process of the electrostatic attraction of the fluid.

In addition, because the diameter of the fluid-ejecting hole of the nozzle is equal to or less than the droplet diameter of the fluid which has just been ejected, it is possible to equalize the region where the electric charge is concentrated and the meniscus region of the fluid.

According to the above, it is possible to drastically reduce the voltage required for the movement of the electric charge, that is, the voltage required for applying to the fluid the electric charge whose amount is such that the fluid is electrostatically attracted so as to be ejected in the form of a droplet having a desired diameter. On this account, it is not necessary to apply a high voltage of 2,000 V which is conventional necessary. As a result, it is possible to improve safety when a fluid jet device is used.

Moreover, because it is possible to reduce the area of the electric field as described above, it becomes possible to generate a high electric field in a small region. As a result, it becomes possible to form minute droplets. On this account, when the droplet is an ink, it becomes possible to realize a high resolution printed image.

Further, because the region where the electric charge is concentrated and the meniscus region of the fluid become substantially the same in size, the amount of time for the electric charge to move in the meniscus region does not influence the response of ejection. As a result, it is possible to improve the velocity of the ejected droplet (print speed when the droplet is an ink).

Moreover, because the region where the electric charge is concentrated and the meniscus region of the fluid becomes substantially the same in size, it becomes unnecessary to generate a high electric field in a large meniscus region. Therefore, unlike the conventional inventions, it becomes unnecessary to accurately place the counter electrode in order to generate the high electric field in the large meniscus region. In addition, the dielectric constant and the thickness of the printing medium do not influence the positioning of the counter electrode any more.

Therefore, in the electrostatic attraction fluid jet device, the freedom of the positioning of the counter electrode increases. That is, the freedom of the designing of the electrostatic attraction fluid jet device increases. As a result, it becomes possible to print to a printing medium which is conventionally difficult to use, and possible to realize a fluid jet device which is highly versatile, without being influenced by the dielectric constant or the thickness.

Therefore, according to the electrostatic attraction fluid jet device arranged as above, it is possible to realize a device which has high definition, is safe and is highly versatile.

Here, as the fluid, it is possible to use (i) purified-water, (ii) oil, (iii) an ink which is a colored fluid containing dyes or pigments as fine particles, (iv) solution containing wiring materials (conductive fine particles, such as silver, copper, etc.) for forming a circuit substrate, etc.

For example, in the case in which the ink is used as the fluid, it is possible to realize high definition printing. In the case in which the solution containing wiring materials for forming the circuit substrate is used as the fluid, it becomes possible to form a super high definition substrate whose line width of the wiring is very narrow.

In addition, in order to solve the above problems, the electrostatic attraction fluid jet device according to the present invention ejects a fluid, which is electrified by a voltage application, by an electrostatic attraction in the form of a droplet from a fluid-ejecting hole of a nozzle made of an insulating material, wherein a diameter of the fluid-ejecting hole of the nozzle is equal to or less than Φ8 μm.

According to the above arrangement, it becomes possible to decrease the size of the electric field, which is conventionally large, by setting the nozzle diameter so that the nozzle diameter is substantially equal to the diameter of the tip portion, where the electric charge is concentrated, of the taylor cone formed for ejecting a fluid whose droplet diameter is shorter than the diameter of the fluid-ejecting hole of the conventional nozzle in the conventional process of the electrostatic attraction of the fluid.

According to the above, it is possible to drastically reduce the voltage required for the movement of the electric charge, that is, the voltage required for applying to the fluid the electric charge required for electrostatically attracting the fluid. On this account, it is not necessary to apply a high voltage of 2,000 V which is conventional necessary. As a result, it is possible to improve safety when a fluid jet device is used.

Moreover, because the diameter of the fluid-ejecting hole of the nozzle is equal to or less than Φ8 μm, the intensity distribution of the electric field concentrates near an ejecting surface of the fluid-ejecting hole. Moreover, the change in the distance between the counter electrode and the fluid-ejecting hole of the nozzle does not influence the intensity distribution of the electric field any more.

Therefore, it is possible to eject the fluid stably without being influenced by (i) the positioning accuracy of the counter electrode and (ii) the variation of the material characteristics or the variation of the thickness of the printing medium.

Moreover, because it is possible to reduce the area of the electric field as described above, it becomes possible to generate a high electric field in a small area. As a result, it becomes possible to form minute droplets. On this account, when the droplet is an ink, it becomes possible to realize a high resolution printed image.

Furthermore, because the region where the electric charge is concentrated and the meniscus region of the fluid become the same in size, the amount of time for the electric charge to move in the meniscus region does not influence the response of ejection. As a result, it is possible to improve the velocity of the ejected droplet (print speed when the droplet is an ink).

Moreover, because the region where the electric charge is concentrated and the meniscus region of the fluid becomes substantially the same in size, it becomes unnecessary to generate the high electric field in the large meniscus region. Therefore, unlike the conventional inventions, it becomes unnecessary to accurately place the counter electrode in order to generate the high electric field in the large meniscus region. In addition, the dielectric constant and the thickness of the printing medium do not influence the positioning of the counter electrode any more.

Therefore, in the electrostatic attraction fluid jet device, the freedom of the positioning of the counter electrode increases. That is, the freedom of the designing of the electrostatic attraction fluid jet device increases. As a result, it becomes possible to print to a printing medium which is conventionally difficult to use, and possible to realize a fluid jet device which is highly versatile, without being influenced by the dielectric constant or the thickness.

Therefore, according to the electrostatic attraction fluid jet device arranged as above, it is possible to realize a device which has high definition, is safe and is highly versatile.

Here, as the fluid, it is possible to use (i) purified water, (ii) oil, (iii) an ink which is a colored fluid containing dyes or pigments as fine particles, (iv) solution containing wiring materials (conductive fine particles, such as silver, copper, etc.) for forming a circuit substrate, etc.

For example, in the case in which the ink is used as the fluid, it is possible to realize high definition printing. In the case in which the solution containing wiring materials for forming the circuit substrate is used as the fluid, it becomes possible to form a super high definition substrate whose line width of the wiring is very narrow. Therefore, in either case, it is possible to eject the fluid stably.

Moreover, in order to solve the above problems, the electrostatic attraction fluid jet device of the present invention ejects a fluid, which is electrified by a voltage application, by an electrostatic attraction in the form of a droplet from a fluid-ejecting hole of a nozzle made of an insulating material, wherein an applied voltage control section which controls a voltage applied to the fluid in the nozzle is included, a diameter of the fluid-ejecting hole of the nozzle is equal to or less than Φ8 μm, and the applied voltage control section controls a voltage applied to the fluid so that the amount of electric charge, induced to a droplet of the fluid which droplet has just been ejected from the fluid-ejecting hole, is equal to or less than 90% of the amount of electric charge corresponding to Rayleigh limit of the droplet.

According to the above arrangement, it becomes possible to decrease the size of the electric field, which is conventionally large, by setting the nozzle diameter so that the nozzle diameter is substantially equal to the diameter of the tip portion, where the electric charge is concentrated, of the taylor cone formed for ejecting a fluid whose droplet diameter is shorter than the diameter of the fluid-ejecting hole of the conventional nozzle in the conventional process of the electrostatic attraction of the fluid.

According to the above, it is possible to drastically reduce the voltage required for the movement of the electric charge, that is, the voltage required for applying to the fluid the electric charge required for electrostatically attracting the fluid. On this account, it is not necessary to apply a high voltage of 2,000 V which is conventional necessary. As a result, it is possible to improve safety when a fluid jet device is used.

Moreover, because the diameter of the fluid-ejecting hole of the nozzle is equal to or less than Φ8 μm, the intensity distribution of the electric field concentrates near an ejecting surface of the fluid-ejecting hole. Moreover, the change in the distance between the counter electrode and the fluid-ejecting hole of the nozzle does not influence the intensity distribution of the electric field any more.

Therefore, it is possible to eject the fluid stably without being influenced by (i) the positioning accuracy of the counter electrode and (ii) the variation of the material characteristics or the variation of the thickness of the printing medium.

Moreover, because it is possible to reduce the area of the electric field as described above, it becomes possible to generate a high electric field in a small area. As a result, it becomes possible to form minute droplets. On this account, when the droplet is an ink, it becomes possible to realize a high resolution printed image.

Furthermore, because the region where the electric charge is concentrated and the meniscus region of the fluid become the same in size, the amount of time for the electric charge to move in the meniscus region does not influence the response of ejection. As a result, it is possible to improve the velocity of the ejected droplet (print speed when the droplet is an ink).

Moreover, because the region where the electric charge is concentrated and the meniscus region of the fluid becomes substantially the same in size, it becomes unnecessary to generate the high electric field in the large meniscus region.

Therefore, unlike the conventional inventions, it becomes unnecessary to accurately place the counter electrode in order to generate the high electric field in the large meniscus region. In addition, the dielectric constant and the thickness of the printing medium do not influence the positioning of the counter electrode any more.

Therefore, in the electrostatic attraction fluid jet device, the freedom of the positioning of the counter electrode increases. That is, the freedom of the designing of the electrostatic attraction fluid jet device increases. As a result, it becomes possible to print to a printing medium which is conventionally difficult to use, and possible to realize a fluid jet device which is highly versatile, without being influenced by the dielectric constant or the thickness.

Therefore, according to the electrostatic attraction fluid jet device arranged as above, it is possible to realize a device which has high definition, is safe and is highly versatile.

Here, as the fluid, it is possible to use (i) purified water, (ii) oil, (iii) an ink which is a colored fluid containing dyes or pigments as fine particles, (iv) solution containing wiring materials (conductive fine particles, such as silver, copper, etc.) for forming a circuit substrate, etc.

For example, in the case in which the ink is used as the fluid, it is possible to realize high definition printing. In the case in which the solution containing wiring materials for forming the circuit substrate is used as the fluid, it becomes possible to form a super high definition substrate whose line width of the wiring is very narrow. Therefore, in either case, it is possible to eject the fluid stably.

Furthermore, the applied voltage control section controls a voltage applied to the fluid so that the amount of electric charge induced to a droplet of the fluid which has just been ejected from the fluid-ejecting hole is equal to or less than 90% of the amount of electric charge corresponding to Rayleigh limit of the droplet. In this way, it is possible to prevent (i) discharging caused by the reduction of the surface area of the droplet due to the drying of the ejected droplet, and (ii) the reduction of the vapor pressure due to the electrification of the droplet.

Therefore, it becomes possible to lower the reduction of a drying time (time until all the solution of the droplet is vaporized) of the ejected droplet, so that it is possible to adjust the variation of the size of the dot diameter of a landed droplet.

Moreover, because the drying time of the ejected droplet becomes long, it is possible to reduce the change in the diameter of the droplet, that is, the change in the amount of the droplet until the droplet lands. On this account, the environmental condition, such as air resistance, ambient humidity, etc. are even for each droplet. Therefore, it becomes possible to attempt to improve the positioning accuracy of the droplet, that is, possible to suppress the variation of the droplet when landing.

Furthermore, the drying time of the ejected droplet becomes long. Therefore, even when the diameter of the ejected droplet is about Φ5 μm, that is, even when the diameter of the ejected droplet is very minute, it is possible to land the droplet without drying the droplet.

Therefore, by using the electrostatic attraction fluid jet device arranged as above, it is possible to stably eject minute droplets, and also possible to land the droplet with high accuracy.

The following description explains how the amount of electric charge induced to a droplet of the fluid which has just been ejected from the fluid-ejecting hole is set to be equal to or less than 90% of the amount of electric charge corresponding to Rayleigh limit of the droplet.

That is, in order to solve the above problems, the electrostatic attraction fluid jet device of the present invention ejects a fluid, which is electrified by a voltage application, by an electrostatic attraction in the form of a droplet from a fluid-ejecting hole of a nozzle made of an insulating material, wherein an applied voltage control section which controls a voltage applied to the fluid in the nozzle is included, a diameter of the fluid-ejecting hole of the nozzle is equal to or less than a diameter of the droplet, which has just been ejected, of the fluid, and the applied voltage control section controls a voltage applied to a fluid so that the amount of electric charge, induced to a droplet of the fluid which droplet has just been ejected from the fluid-ejecting hole, is equal to or less than the amount of electric charge corresponding to Rayleigh limit of the droplet which has just been ejected by an electric field whose intensity is maximum at the meniscus.

Moreover, in order to solve the above problems, the electrostatic attraction fluid jet device of the present invention ejects a fluid, which is electrified by a voltage application, on a printing medium with a speed corresponding to an applied voltage, the fluid being ejected in the form of a droplet by an electrostatic attraction from a fluid-ejecting hole of a nozzle made of an insulating material, wherein an applied voltage control section which controls a voltage applied to the fluid in the nozzle is included, a diameter of the fluid-ejecting hole of the nozzle is equal to or less than Φ8 μm, and the applied voltage control section controls a voltage applied to the fluid so that an average velocity of the fluid, which is ejected and lands on a printing medium, is not less than 10 m/s and not more than 40 m/s.

According to the above arrangement, it becomes possible to decrease the size of the electric field, which is conventionally large, by setting the nozzle diameter so that the nozzle diameter is substantially equal to the diameter of the tip portion, where the electric charge is concentrated, of the taylor cone formed for ejecting a fluid whose droplet diameter is shorter than the diameter of the fluid-ejecting hole of the conventional nozzle in the conventional process of the electrostatic attraction of the fluid.

According to the above, it is possible to drastically reduce the voltage required for the movement of the electric charge, that is, the voltage required for applying to the fluid the electric charge required for electrostatically attracting the fluid. On this account, it is not necessary to apply a high voltage of 2,000 V which is conventional necessary. As a result, it is possible to improve safety when a fluid jet device is used.

Moreover, because the diameter of the fluid-ejecting hole of the nozzle is equal to or less than Φ8 μm, the intensity distribution of the electric field concentrates near an ejecting surface of the fluid-ejecting hole. Moreover, the change in the distance between the counter electrode and the fluid-ejecting hole of the nozzle does not influence the intensity distribution of the electric field any more.

Therefore, it is possible to eject the fluid stably without being influenced by (i) the positioning accuracy of the counter electrode and (ii) the variation of the material characteristics or the variation of the thickness of the printing medium.

Moreover, because it is possible to reduce the area of the electric field as described above, it becomes possible to generate a high electric field in a small area. As a result, it becomes possible to form minute droplets. On this account, when the droplet is an ink, it becomes possible to realize a high resolution printed image.

Furthermore, because the region where the electric charge is concentrated and the meniscus region of the fluid become the same in size, the amount of time for the electric charge to move in the meniscus region does not influence the response of ejection. As a result, it is possible to improve the velocity of the ejected droplet (print speed when the droplet is an ink).

Moreover, because the region where the electric charge is concentrated and the meniscus region of the fluid becomes substantially the same in size, it becomes unnecessary to generate the high electric field in the large meniscus region. Therefore, unlike the conventional inventions, it becomes unnecessary to accurately place the counter electrode in order to generate the high electric field in the large meniscus region. In addition, the dielectric constant and the thickness of the printing medium do not influence the positioning of the counter electrode any more.

Therefore, in the electrostatic attraction fluid jet device, the freedom of the positioning of the counter electrode increases. That is, the freedom of the designing of the electrostatic attraction fluid jet device increases. As a result, it becomes possible to print to a printing medium which is conventionally difficult to use, and possible to realize a fluid jet device which is highly versatile, without being influenced by the dielectric constant or the thickness.

Therefore, according to the electrostatic attraction fluid jet device arranged as above, it is possible to realize a device which has high definition, is safe and is highly versatile.

Here, as the fluid, it is possible to use (i) purified water, (ii) oil, (iii) an ink which is a colored fluid containing dyes or pigments as fine particles, (iv) solution containing wiring materials (conductive fine particles, such as silver, copper, etc.) for forming a circuit substrate, etc.

For example, in the case in which the ink is used as the fluid, it is possible to realize high definition printing. In the case in which the solution containing wiring materials for forming the circuit substrate is used as the fluid, it becomes possible to form a super high definition substrate whose line width of the wiring is very narrow. Therefore, in either case, it is possible to eject the fluid stably.

In addition, the applied voltage control section controls a voltage applied to the fluid so that the average velocity of the ejected droplet, which is ejected and lands on the printing medium, is not less than 10 m/s and not more than 40 m/s. In this way, it is possible to reduce the influence of the drying of the fluid while flying. As a result, it is possible to improve the positioning accuracy of the droplet onto the printing medium, possible to suppress the variation of the dot diameter of the landed droplet, and possible to prevent the generation of the mist of the ejected droplet, the mist generated by the influence of the electric field intensity at the meniscus portion. As a result, it is possible to stably eject droplets.

Here, when the average velocity of the ejected droplet, which is ejected and lands on the printing medium, is less than 10 m/s, the positioning accuracy becomes bad and the stability of ejection becomes bad, too. Therefore, the dot diameter of the landed droplet varies. Moreover, when the average velocity of the ejected droplet, which is ejected and lands on the printing medium, is more than 40 m/s, a high voltage is required. Therefore, the electric field intensity becomes very strong at the meniscus portion, and the generation of the mist of the ejected droplet occurs frequently. Therefore, it is impossible to stably eject droplets.

Therefore, as in the electrostatic attraction fluid jet device arranged as above, the average velocity of the ejected droplet, which is ejected and lands on the printing medium, is not less than 10 m/s and not more than 40 m/s. In this way, it becomes possible to stably eject the droplet. As a result, it is possible to improve the positioning accuracy of the droplet, and also possible to suppress the variation of the dot diameter of the landed droplet.

Moreover, the electrostatic attraction fluid jet device arranged as above can be realized by the following arrangement.

That is, the electrostatic attraction fluid jet device of the present invention ejects a fluid, which is electrified by a voltage application, on a printing medium with a speed corresponding to an applied voltage, the fluid being ejected in the form of a droplet by an electrostatic attraction from a fluid-ejecting hole of a nozzle made of an insulating material, wherein an applied voltage control section which controls a voltage applied to the fluid in the nozzle is included, a diameter of the fluid-ejecting hole of the nozzle is equal to or less than a diameter of the droplet, which has just been ejected, of the fluid, and the applied voltage control section controls a voltage applied to the fluid so that an average velocity of the fluid, which is ejected and lands on a printing medium, is not less than 10 m/s and not more than 40 m/s.

Further, in order to solve the above problems, the electrostatic attraction fluid jet device of the present invention ejects a fluid, which contains fine particles and is electrified by a voltage application, by an electrostatic attraction in the form of a droplet from a fluid-ejecting hole of a nozzle made of an insulating material, wherein a diameter of the fluid-ejecting hole of the nozzle is equal to or less than Φ8 μm, and a particle diameter of each of the fine particles contained in the fluid is equal to or less than Φ30 nm.

According to the above arrangement, it becomes possible to decrease the size of the electric field, which is conventionally large, by setting the nozzle diameter so that the nozzle diameter is substantially equal to the diameter of the tip portion, where the electric charge is concentrated, of the taylor cone formed for ejecting a fluid whose droplet diameter is shorter than the diameter of the fluid-ejecting hole of the conventional nozzle in the conventional process of the electrostatic attraction of the fluid.

According to the above, it is possible to drastically reduce the voltage required for the movement of the electric charge, that is, the voltage required for applying to the fluid the electric charge required for electrostatically attracting the fluid. On this account, it is not necessary to apply a high voltage of 2,000 V which is conventional necessary. As a result, it is possible to improve safety when a fluid jet device is used.

Moreover, because the diameter of the fluid-ejecting hole of the nozzle is equal to or less than Φ8 μm, the intensity distribution of the electric field concentrates near an ejecting surface of the fluid-ejecting hole. Moreover, the change in the distance between the counter electrode and the fluid-ejecting hole of the nozzle does not influence the intensity distribution of the electric field any more.

Therefore, it is possible to eject the fluid stably without being influenced by (i) the positioning accuracy of the counter electrode and (ii) the variation of the material characteristics or the variation of the thickness of the printing medium.

Moreover, because it is possible to reduce the area of the electric field as described above, it becomes possible to generate a high electric field in a small area. As a result, it becomes possible to form minute droplets. On this account, when the droplet is an ink, it becomes possible to realize a high resolution printed image.

Furthermore, because the region where the electric charge is concentrated and the meniscus region of the fluid become the same in size, the amount of time for the electric charge to move in the meniscus region does not influence the response of ejection. As a result, it is possible to improve the velocity of the ejected droplet (print speed when the droplet is an ink).

Moreover, because the region where the electric charge is concentrated and the meniscus region of the fluid becomes substantially the same in size, it becomes unnecessary to generate the high electric field in the large meniscus region. Therefore, unlike the conventional inventions, it becomes unnecessary to accurately place the counter electrode in order to generate the high electric field in the large meniscus region. In addition, the dielectric constant and the thickness of the printing medium do not influence the positioning of the counter electrode any more.

Therefore, in the electrostatic attraction fluid jet device, the freedom of the positioning of the counter electrode increases. That is, the freedom of the designing of the electrostatic attraction fluid jet device increases. As a result, it becomes possible to print to a printing medium which is conventionally difficult to use, and possible to realize a fluid jet device which is highly versatile, without being influenced by the dielectric constant or the thickness.

Therefore, according to the electrostatic attraction fluid jet device arranged as above, it is possible to realize a device which has high definition, is safe and is highly versatile.

Here, as the fluid, it is possible to use (i) purified water, (ii) oil, (iii) an ink which is a colored fluid containing dyes or pigments as fine particles, (iv) solution containing wiring materials (conductive fine particles, such as silver, copper, etc.) for forming a circuit substrate, etc.

For example, in the case in which the ink is used as the fluid, it is possible to realize high definition printing. In the case in which the solution containing wiring materials for forming the circuit substrate is used as the fluid, it becomes possible to form a super high definition substrate whose line width of the wiring is very narrow. Therefore, in either case, it is possible to eject the fluid stably.

In addition, because the particle diameter of the fine particle contained in the fluid is equal to or less than Φ30 nm, it is possible to reduce the influence of the electrified fine particle to the fine particle itself. Therefore, even when a droplet contains fine particles, it is possible to stably eject the droplet.

Moreover, it is possible to reduce the influence of the electrified fine particle to the fine particle itself. Therefore, unlike the conventional case in which the fluid is ejected by utilizing the electrification of the fine particles, the movement of the fine particle does not become slow when the particle diameter is short. Therefore, the recording velocity does not become low even when the fluid, such as an ink, contains fine particles.

Moreover, the electrostatic attraction fluid jet device arranged as above can be realized by the following arrangement.

That is, the electrostatic attraction fluid jet device of the present invention ejects a fluid, which contains fine particles and is electrified by a voltage application, by an electrostatic attraction in the form of a droplet from a fluid-ejecting hole of a nozzle made of an insulating material, wherein a diameter of the fluid-ejecting hole of the nozzle is equal to or less than a diameter of the droplet, which has just been ejected, of the fluid, and a particle diameter of each of the fine particles contained in the fluid is equal to or less than Φ30 nm.

Additional objects, features, and strengths of the present invention will be made clear by the description below. Further, the advantages of the present invention will be evident from the following explanation in reference to the drawings.

BRIEF DESCRIPTION OF DRAWINGS

FIG. 3(*b*) is a graph illustrating a relationship between a distance from a center of a nozzle and a distance from a counter electrode when a distance between the nozzle and the counter electrode is 100 μm.

FIG. 4(*b*) is a graph illustrating a relationship between a distance from a center of a nozzle and a distance from a counter electrode when a distance between the nozzle and the counter electrode is 100 μm.

FIG. 5(*b*) is a graph illustrating a relationship between a distance from a center of a nozzle and a distance from a counter electrode when a distance between the nozzle and the counter electrode is 100 μm.

FIG. 6(*b*) is a graph illustrating a relationship between a distance from a center of a nozzle and a distance from a counter electrode when a distance between the nozzle and the counter electrode is 100 μm.

FIG. 7(*b*) is a graph illustrating a relationship between a distance from a center of a nozzle and a distance from a counter electrode when a distance between the nozzle and the counter electrode is 100 μm.

FIG. 8(*b*) is a graph illustrating a relationship between a distance from a center of a nozzle and a distance from a counter electrode when a distance between the nozzle and the counter electrode is 100 μm.

BEST MODE FOR CARRYING OUT THE INVENTION

Embodiment

The following description explains the best mode (hereinafter referred to as "embodiment") for carrying out the present invention. Note that, the present embodiment explains an electrostatic attraction ink jet device which uses ink as a fluid.

Figure 1:
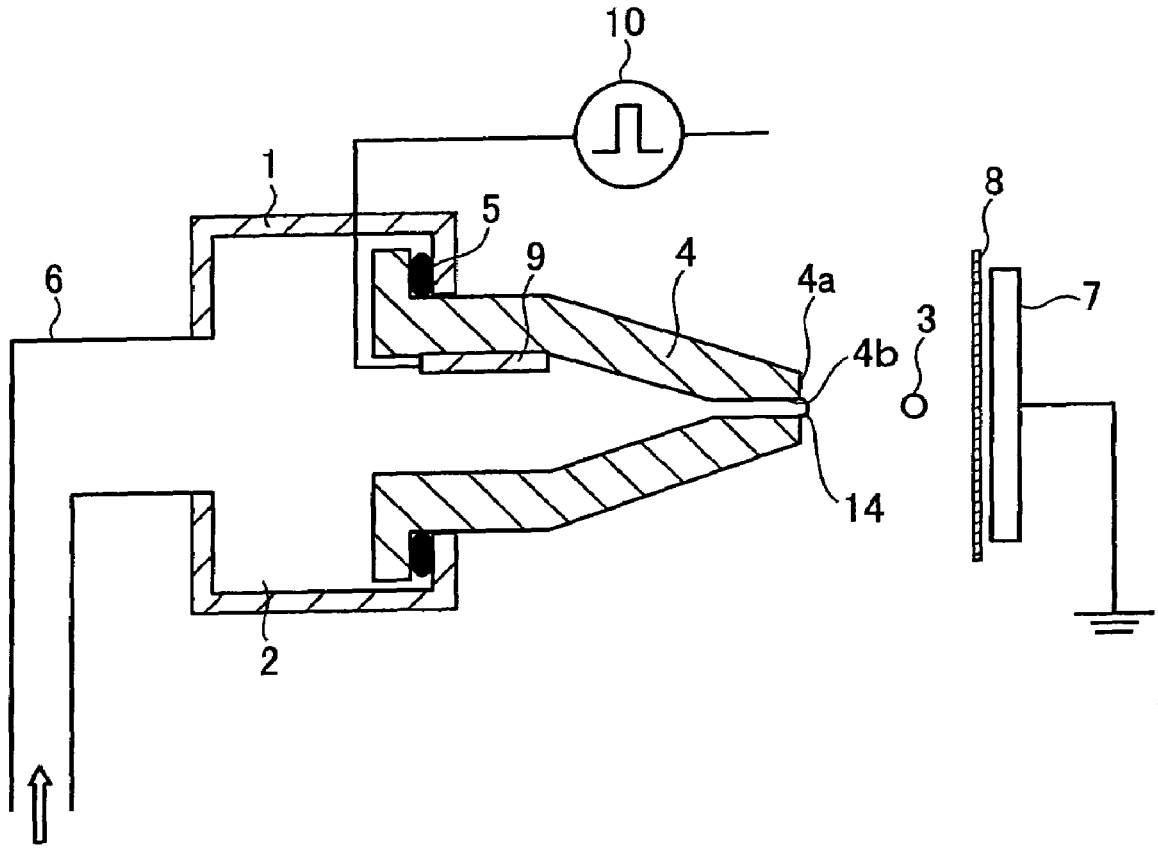
FIG. 1 is a cross-sectional view illustrating a schematic arrangement of an ink jet device in accordance with one embodiment of the present invention.

FIG. 1 is a diagram illustrating an arrangement of an ink jet device according to the present embodiment.

As illustrated in FIG. 1, the ink jet device includes a nozzle 4 for ejecting ink 2 which is stored as a fluid in an ink chamber 1. The nozzle 4 is connected with the ink chamber 1 via gaskets 5. In this way, a joint portion between the nozzle 4 and the ink chamber 1 is sealed so that the ink 2 in the ink chamber 1 does not leak to the outside.

Moreover, an internal diameter of the nozzle 4 becomes shorter toward a tip portion 4*a* which is on the opposite side of the joint portion between the ink chamber 1 and the nozzle 4, that is, the side from which the ink is ejected. An internal diameter (diameter) of an ink-ejecting hole 4*b* of the tip portion 4*a* of the nozzle 4 is determined in relation to a particle diameter of the ink 2 which has just been ejected.

Note that, in order to distinguish between the ink 2 ejected from the nozzle 4 and the ink 2 stored in the ink chamber 1, the ink 2 ejected from the nozzle 4 is hereinafter referred to as "droplet 3". The detail of the relationship between the diameter of the ink-ejecting hole 4*b* and a droplet diameter of the droplet 3 which has just been ejected will be described later.

Further, inside the nozzle 4, an electrostatic field applying electrode 9 is provided in order to apply an electrostatic field to the ink 2. The electrostatic field applying electrode 9 is connected with a process control section 10. The process control section 10 controls the intensity of an electric field generated by an applied voltage from a drive circuit (not illustrated). By controlling the electric field intensity, the droplet diameter of the droplet 3 ejected from the nozzle 4 is adjusted. That is, the process control section 10 acts as an applied voltage controlling means which controls a voltage applied to the ink 2 through the electrostatic field applying electrode 9.

A counter electrode 7 is provided so that the counter electrode 7 faces with the ink-ejecting hole 4*b* of the nozzle 4 and there is a predetermined distance between the counter electrode 7 and the ink-ejecting hole 4*b*. The counter electrode 7 electrifies the surface of a printing medium 8, which is fed between the nozzle 4 and the counter electrode 7, with a potential whose polarity is a reverse polarity of an electrified potential of the droplet 3 ejected from the ink-ejecting hole 4*b* of the nozzle 4. In this way, the droplet 3 ejected from the ink-ejecting hole 4*b* of the nozzle 4 is stably landed onto the surface of the printing medium 8.

Thus, the droplet 3 needs to be electrified. Therefore, it is preferable that at least an ink-ejecting surface of the tip portion 4*a* of the nozzle 4 be formed by an insulating member. In addition, because it is necessary to form a minute nozzle diameter (internal diameter of the ink-ejecting hole 4*b*), a glass capillary tube is used as the nozzle 4 in the present embodiment.

Therefore, in the process of the electrostatic attraction of the ink 2 (fluid), the nozzle 4 is formed to be able to form a meniscus of taylor cone-shaped ink which meniscus is so formed as to eject the droplet whose diameter is shorter than the diameter of the ink-ejecting hole of the nozzle. Moreover, the diameter of the ink-ejecting hole 4*b* of the nozzle 4 is set up to be substantially equal to the diameter of the tip portion of the meniscus of the ink which is about to be ejected, and is set up to be equal to or less than the diameter of the droplet 3 which has just been ejected.

In the ink jet device arranged as above, the process control section 10 controls the voltage, applied to the ink 2 through the electrostatic field applying electrode 9, so that the amount of ink 2 ejected is equal to or less than 1 pl.

In addition to the nozzle 4, the ink chamber 1 is connected with an ink supplying path 6 for supplying the ink 2 from an ink tank (not illustrated). Here, because the ink chamber 1 and the nozzle 4 are filled with the ink 2, a negative pressure is applied to the ink 2.

The following description explains about movements of a meniscus portion (meniscus region) 14 which is formed near the ink-ejecting hole 4*b* when the nozzle 4 ejects the ink 2 as the droplet 3. Each of FIGS. 2(*a*) to 2(*c*) is a model diagram illustrating the movements of the meniscus portion 14 near the ink-ejecting hole 4*b*.

Figure 2:
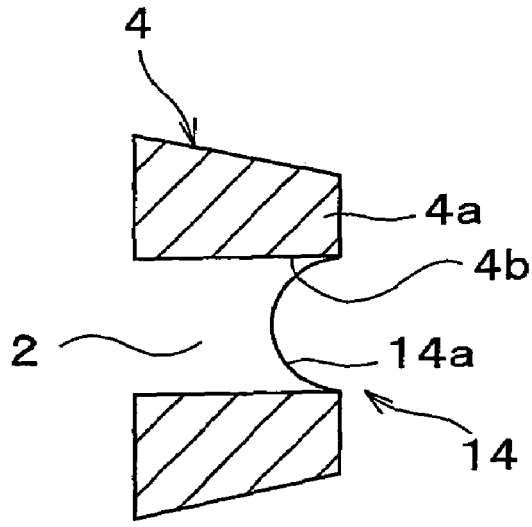
FIGS. 2(*a*) to 2(*c*) are diagrams for explaining movements of a meniscus of ink in the ink jet device illustrated in FIG. 1.
Figure 2:
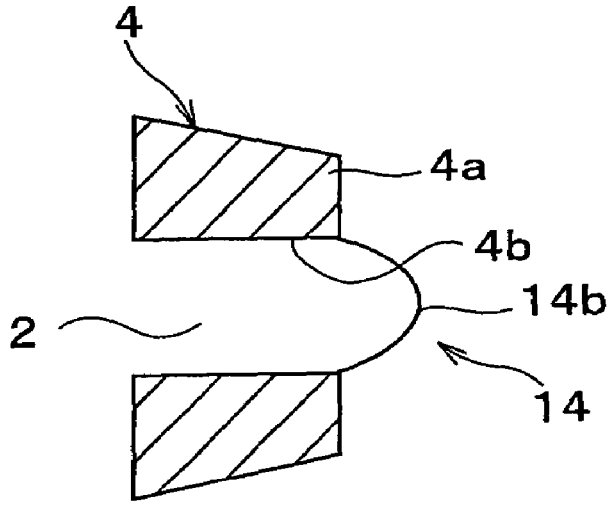
Figure 2:
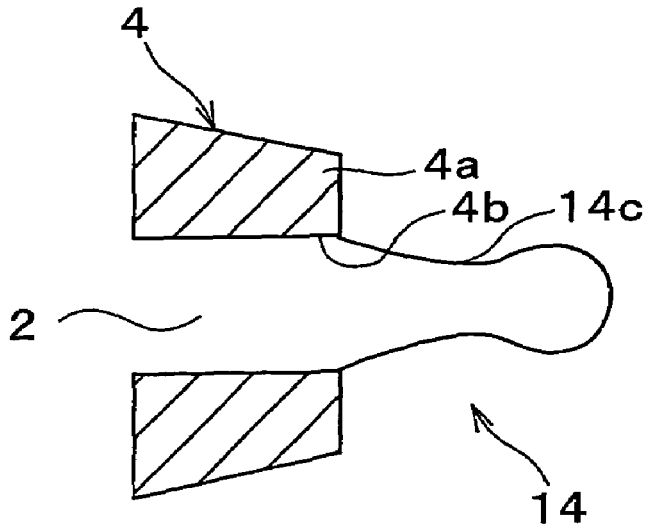

First, as illustrated in FIG. 2(*a*), before the ink 2 is ejected, the negative pressure is applied to the ink. Therefore, as the meniscus portion 14, a meniscus 14*a* is formed in the form of a depression inside the tip portion 4*a* of the nozzle 4.

Next, in order to carry out the ejection of the ink 2, the process control section 10 controls the voltage applied to the ink 2 through the electrostatic field applying electrode 9. When a predetermined voltage is applied to the ink 2, an electric charge is induced to the surface of the ink 2 in the nozzle 4. As illustrated in FIG. 2(*b*), as the meniscus portion 14, the surface of the tip portion 4*a* at the ink-ejecting hole 4*b* of the nozzle 4 is formed, that is, a meniscus 14*b* is formed so that the meniscus 14*b* projects to the side of the counter electrode (not illustrated). At this time, because the diameter of the nozzle 4 is minute, the meniscus 14*b* forms the taylor cone shape from the start and is projecting to the outside.

Then, as illustrated in FIG. 2(*c*), as the meniscus portion 14, the meniscus 14*b* projecting to the outside becomes a meniscus 14*c* which is further projecting to the side of the counter electrode (not illustrated). When the energy of the electric charge induced to the surface of the meniscus 14*c* and the electric field (electric field intensity) generated in the nozzle 4 excels the surface tension energy of the ink 2, the droplet to be ejected is formed.

Here, the internal diameter (hereinafter referred to as "nozzle diameter") of the ink-ejecting hole 4*b* of the nozzle 4 used in the present embodiment is Φ5 μm. When the nozzle diameter of the nozzle 4 is minute as above, it can be thought that a curvature radius of a meniscus tip portion is substantially constant, without such a phenomenon that the curvature radius of the meniscus tip portion gradually decreases because of the concentration of the surface electric charge, the phenomenon having conventionally been occurred.

Therefore, in the case in which the physical-property value of the ink is constant, the surface tension energy when the droplet is separated is constant in a state in which the ejection is carried out by applying a voltage. Moreover, the amount of surface electric charge, which can be concentrated, is equal to or less than a value which exceeds the surface tension energy of the ink, that is, equal to or less than the value of Rayleigh split. Therefore, the maximum amount is defined uniquely.

Note that, because the nozzle diameter is minute, the electric field intensity becomes very strong only in the immediate vicinity of the meniscus portion. Thus, the intensity of the discharge breakdown becomes very high at the high electric field in the minute region. Therefore, no problem occurs.

As the ink used in the ink jet device according to the present embodiment, it is possible to use (i) purified water, (ii) dye-based ink and (iii) ink containing fine particles. Here, because a nozzle portion is conventionally very small, the particle diameter of each of the fine particles in the ink needs to be short, too. Generally, when the particle diameter is from 1/20 to 1/100 of the nozzle, the nozzle is hardly clogged with the fine particles.

On this account, when the nozzle diameter of the nozzle 4 used in the present embodiment is Φ5 μm as above, the particle diameter of each of the fine particles in the ink is equal to or less than 50 nm so as to correspond to the nozzle diameter. Here, in the method in which the electric charge at the meniscus portion is concentrated by moving the fine particles by the electrification and the ink containing fine particles is ejected by electrostatic repulsive forces between the concentrated fine particles, which method is like the method, disclosed in Document 2, of ejecting the ink containing fine particles, the moving velocity of the electrified fine particles in the ink becomes low, and the response velocity of ejection and the recording velocity becomes low, because the fine particle diameter here is much shorter than the conventionally shortest fine particle diameter Φ100 nm.

On the contrary, the present invention do not use the electrostatic repulsive forces between the fine particles electrified, but uses the electric charge on the surface of the meniscus, in order to eject the ink just like a case in which the ink not containing fine particles is ejected. In this case, in order to solve the problem of an unstable ejection caused by the influence of the electric charge of the fine particles in the ink to the electric charge on the surface of the meniscus, it is preferable to adjust the amount of electric charge of the fine particles in the ink so as to cause the amount of electric charge of the fine particles in the ink to be much less than the amount of electric charge on the surface of the meniscus.

When the amount of electric charge of the fine particles in the ink per unit mass is not more than 10 μC/g, the electrostatic repulsive force between the fine particles becomes small and the response velocity becomes low. In addition, by making the mass of fine particles in the ink smaller, that is, by making the diameter of each of the fine particles in the ink shorter, it is possible to reduce the total amount of electric charge of the fine particles in the ink.

In Table 1 below, the stability of ejection is shown when the average diameter of each of the fine particles in the ink is from Φ3 nm to Φ50 nm.

TABLE 1

| FINE PARTICLE | NOZZLE DIAMETER | | | |
|---|---|---|---|---|
| DIAMETER | Φ0.4 μm | Φ1 μm | Φ4 μm | Φ8 μm |
| Φ50 nm | X | Δ | Δ | Δ |
| Φ30 nm | ○ | ○ | ○ | ○ |
| Φ10 nm | ○ | ○ | ○ | ○ |
| Φ3 nm | ○ | ○ | ○ | ○ |

Each mark in Table 1 shows the stability of ejection by each nozzle. x indicates that the ink may not be ejected because the nozzle is clogged, etc. Δ indicates that the ejection becomes unstable when the ink is continuously ejected. ○ indicates that the ink is stably ejected.

It is clear from Table 1 that it is preferable that the diameter of each of the fine particles be equal to or less than Φ30 nm. Especially, when the diameter of each of the fine particles is equal to or less than Φ10 nm, the amount of electrification in one fine particle of the ink hardly influences the ejection of the ink. In addition, the moving velocity by the electric charge becomes very low and the concentration of the fine particles to the center of the meniscus does not occur. Moreover, when the nozzle diameter is equal to or less than Φ03 μm, because of the concentration of the electric field at the meniscus portion, the maximum electric field intensity becomes extremely high and the electrostatic force of each fine particle also becomes large. Therefore, it is preferable to use the ink containing fine particles each having a diameter equal to or less than Φ10 nm. Note that, when the diameter of each of the fine particles is equal to or less than Φ1 nm, the aggregation of the fine particles and variation of the density may occur. Therefore, it is preferable that the diameter of each of the fine particles be from Φ1 nm to Φ10 nm.

In the present embodiment, paste containing silver fine particles whose average diameter is from Φ3 nm to Φ7 nm is used, and these fine particles are coated for preventing aggregation.

Figure 3:
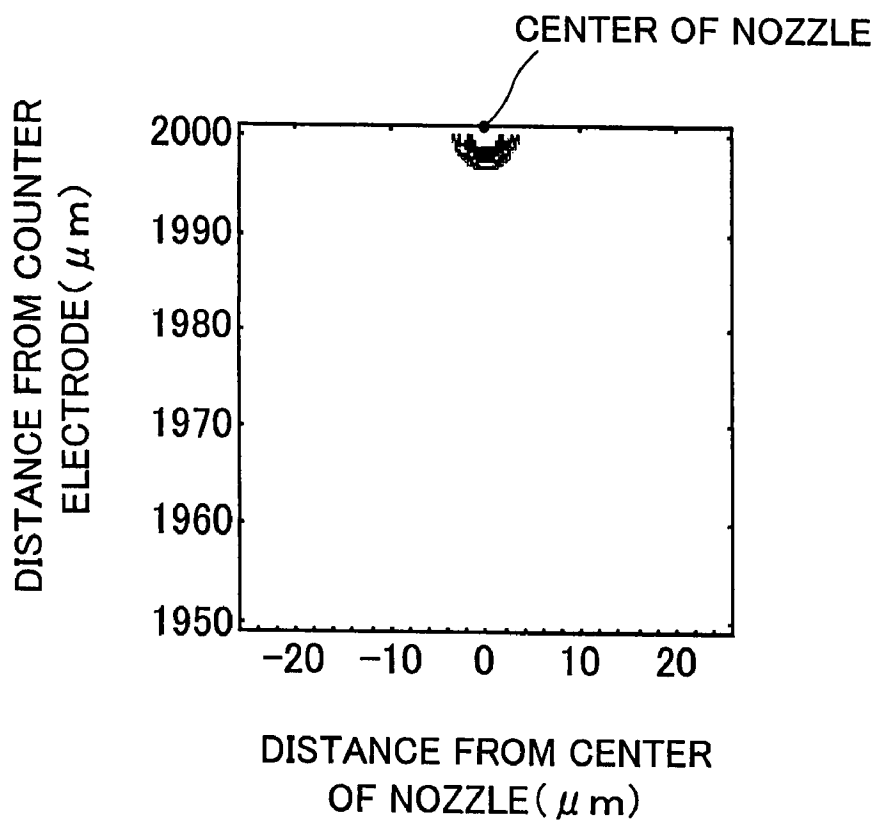
FIG. 3(*a*) is a graph illustrating a relationship between a distance from a center of a nozzle and a distance from a counter electrode when a distance between the nozzle and the counter electrode is 2,000 μm.
Figure 3:
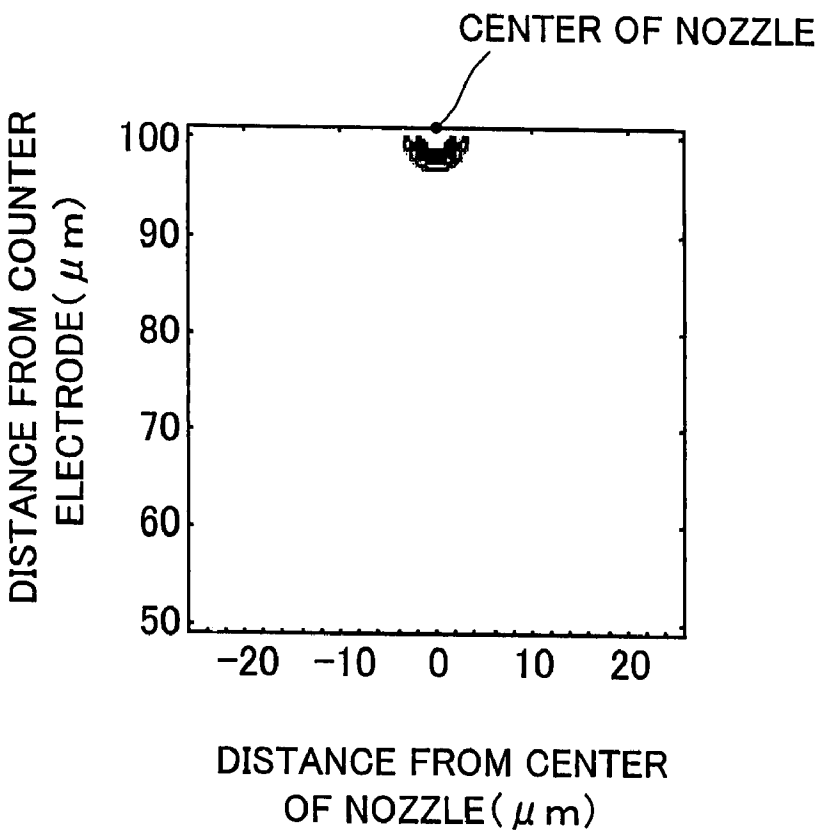
Figure 4:
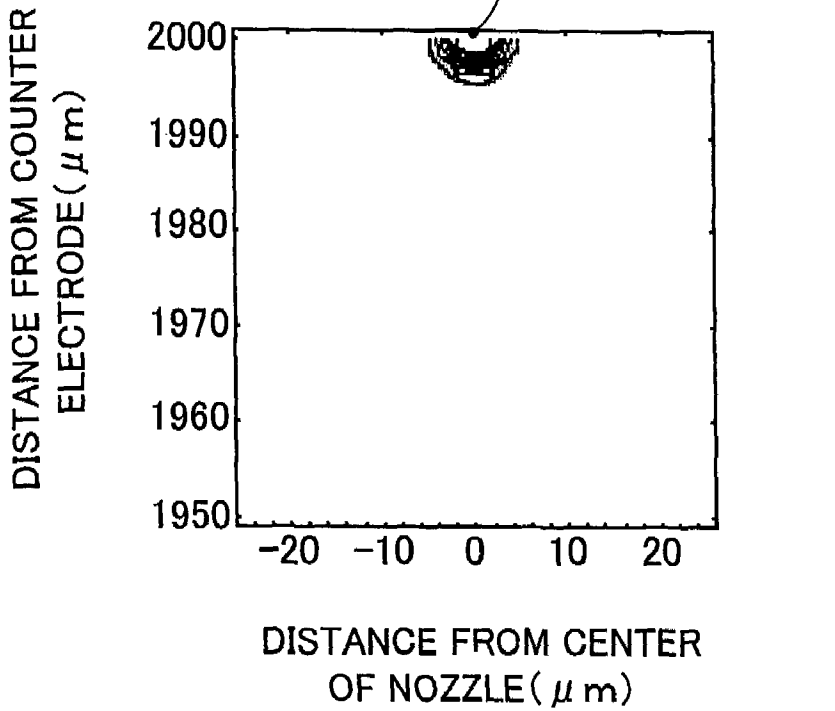
FIG. 4(*a*) is a graph illustrating a relationship between a distance from a center of a nozzle and a distance from a counter electrode when a distance between the nozzle and the counter electrode is 2,000 μm.
Figure 4:
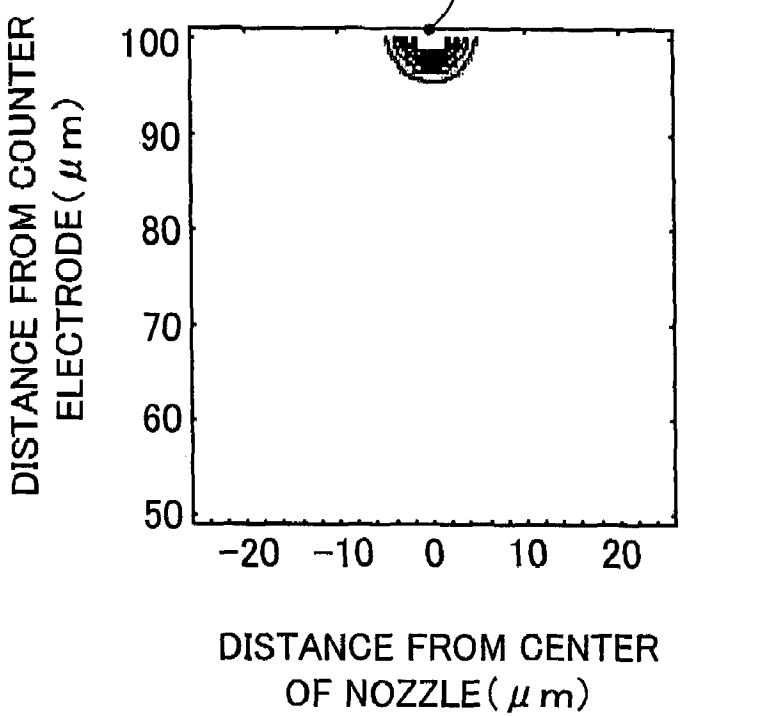
Figure 5:
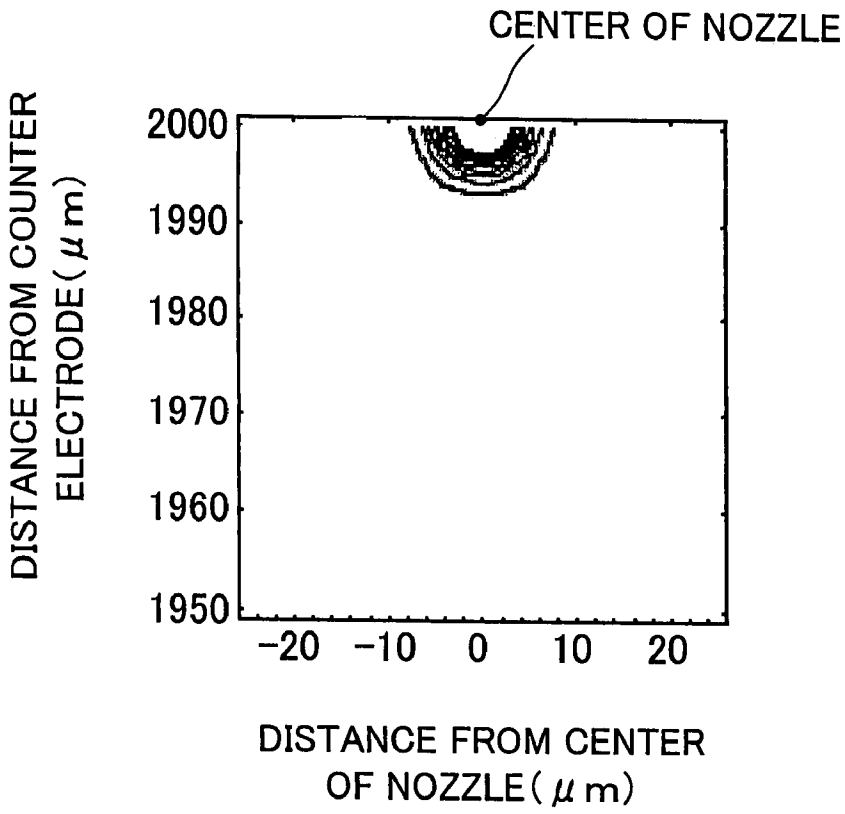
FIG. 5(*a*) is a graph illustrating a relationship between a distance from a center of a nozzle and a distance from a counter electrode when a distance between the nozzle and the counter electrode is 2,000 μm.
Figure 5:
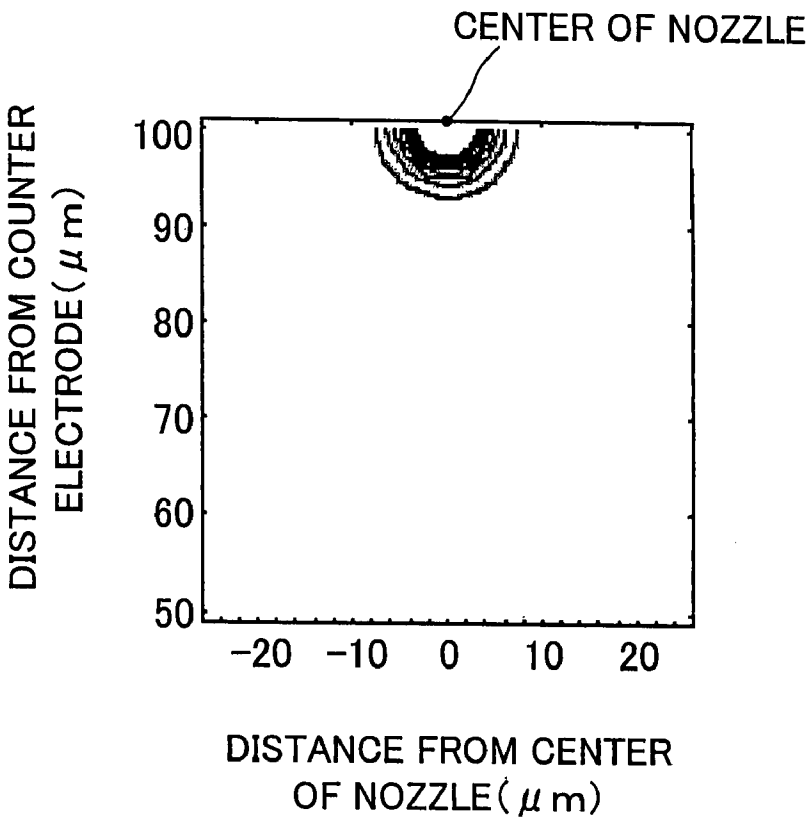
Figure 7:
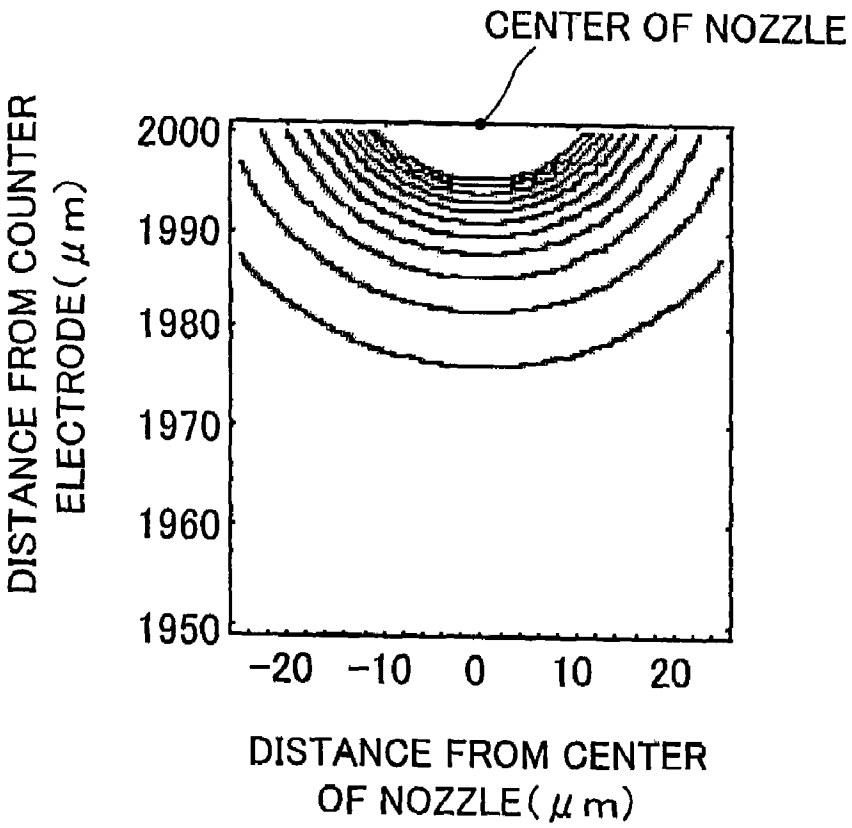
FIG. 7(*a*) is a graph illustrating a relationship between a distance from a center of a nozzle and a distance from a counter electrode when a distance between the nozzle and the counter electrode is 2,000 μm.
Figure 7:
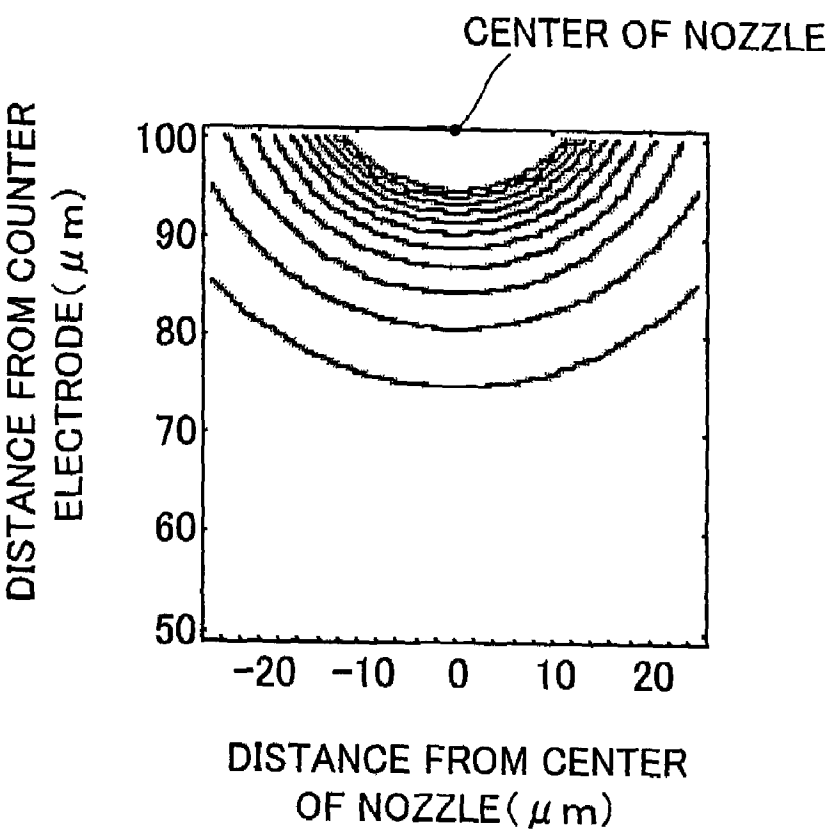
Figure 8:
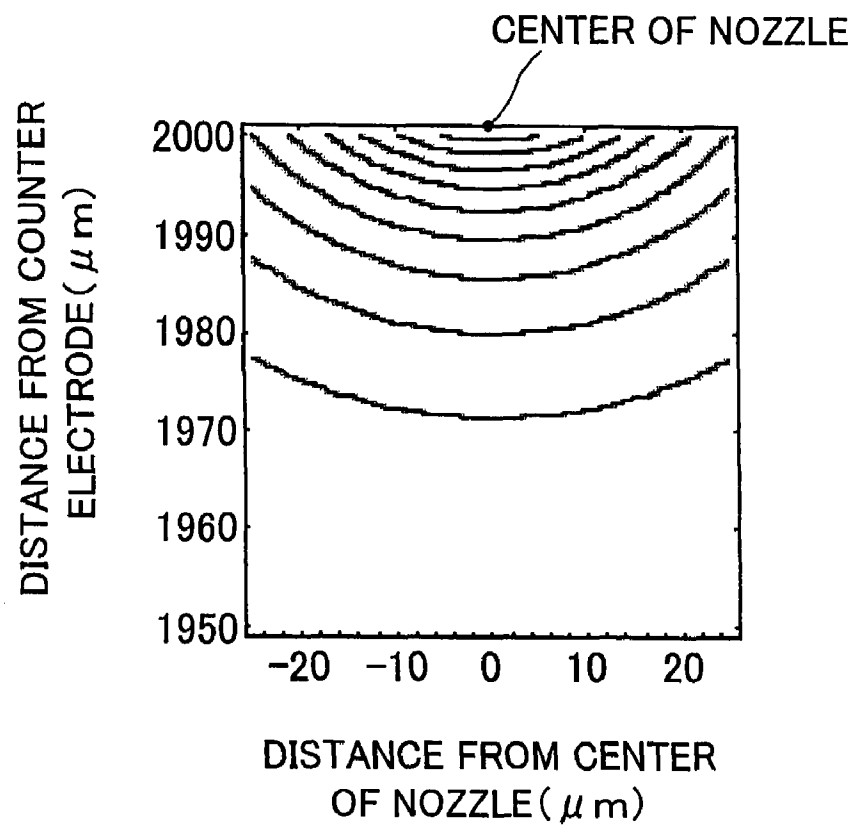
FIG. 8(*a*) is a graph illustrating a relationship between a distance from a center of a nozzle and a distance from a counter electrode when a distance between the nozzle and the counter electrode is 2,000 μm.
Figure 8:
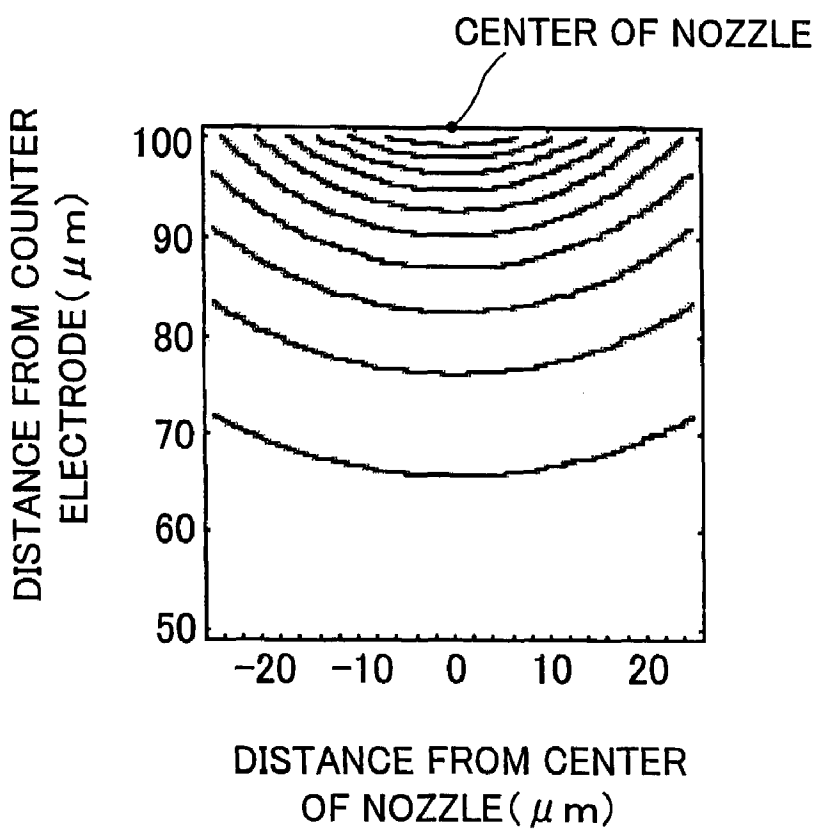

Here, the following description explains the relationship between the nozzle diameter of the nozzle 4 and the electric field intensity in reference to FIGS. 3(*a*) and 3(*b*) to FIGS. 8(*a*) and 8(*b*). Each of FIGS. 3(*a*) and 3(*b*) to FIGS. 8(*a*) and 8(*b*) illustrates the distribution of the electric field intensity. The nozzle diameters are Φ0.2 μm in FIGS. 3(*a*) and 3(*b*), Φ0.4 μm in FIGS. 4(*a*) and 4(*b*), Φ1 μm in FIGS. 5(*a*) and 5(*b*), Φ8 μm in FIGS. 6(*a*) and 6(*b*), and Φ20 μm in FIGS. 7(*a*) and 7(*b*). For reference, FIGS. 8(*a*) and 8(*b*) show a case where the nozzle diameter is Φ50 μm which is conventionally used.

Here, a nozzle center position in each figure indicates the position of the center of the ink-ejecting surface of the ink-ejecting hole 4*b* of the nozzle 4. Moreover, Each of FIGS. 3(*a*), 4(*a*), 5(*a*), 6(*a*), 7(*a*), and 8(*a*) illustrates the distribution of the electric field intensity when the distance between the nozzle and the counter electrode is 2000 μm. Each of FIGS. 3(*b*), 4(*b*), 5(*b*), 6(*b*), 7(*b*), and 8(*b*) illustrates the distribution of the electric field intensity when the distance between the nozzle and the counter electrode is 100 μm. Note that, the applied voltage is 200V in each case. Distribution lines in each figure indicate the electric field intensity ranging from $1\times10^6$ V/m to $1\times10^7$ V/m.

Table 2 below shows the maximum electric field intensity of each case.

TABLE 2

| NOZZLE DIAMETER | GAP (μm) | | RATE OF CHANGE |
|---|---|---|---|
| (μm) | 100 | 2000 | (%) |
| 0.2 | $2.001\times10^9$ | $2.00005\times10^9$ | 0.05 |
| 0.4 | $1.001\times10^9$ | $1.00005\times10^9$ | 0.09 |
| 1 | $0.401002\times10^9$ | $0.40005\times10^9$ | 0.24 |
| 8 | $0.0510196\times10^9$ | $0.05005\times10^9$ | 1.94 |
| 20 | $0.0210476\times10^9$ | $0.0200501\times10^9$ | 4.98 |
| 50 | $0.00911111\times10^9$ | $0.00805\times10^9$ | 13.18 |

According to FIGS. 3(*a*) and 3(*b*) to FIGS. 8(*a*) and 8(*b*), it is clear that, when the nozzle diameter is equal to or more than Φ20 μm (FIGS. 7(*a*) and (*b*)), the distribution of the electric field intensity is broad. In addition, it is clear from Table 2 that the distance between the nozzle and the counter electrode influences the electric field intensity.

Figure 6:
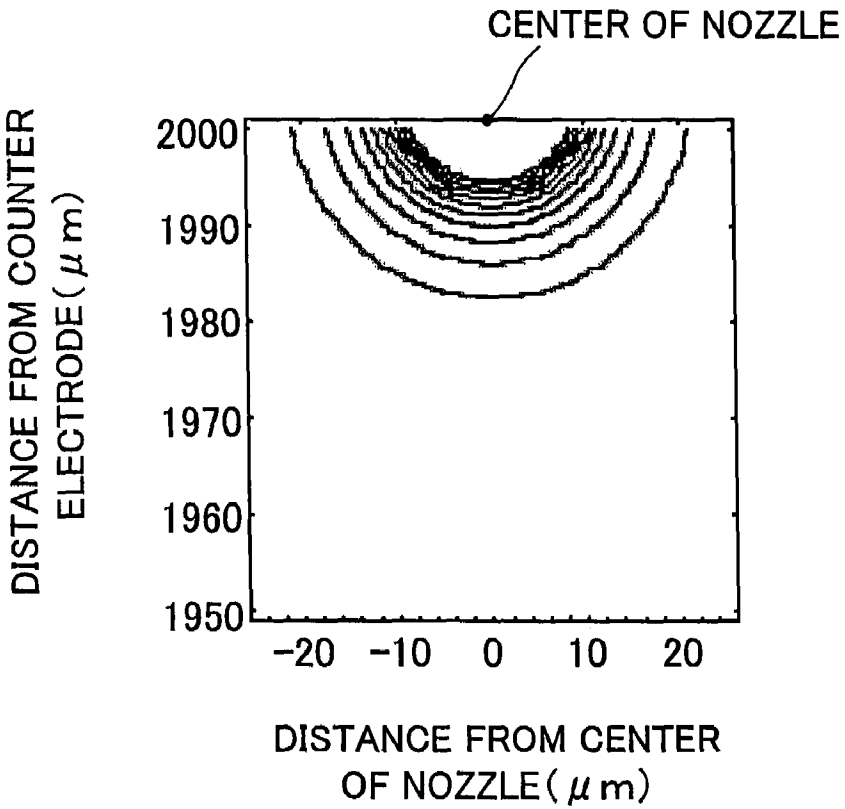
FIG. 6(*a*) is a graph illustrating a relationship between a distance from a center of a nozzle and a distance from a counter electrode when a distance between the nozzle and the counter electrode is 2,000 μm.
Figure 6:
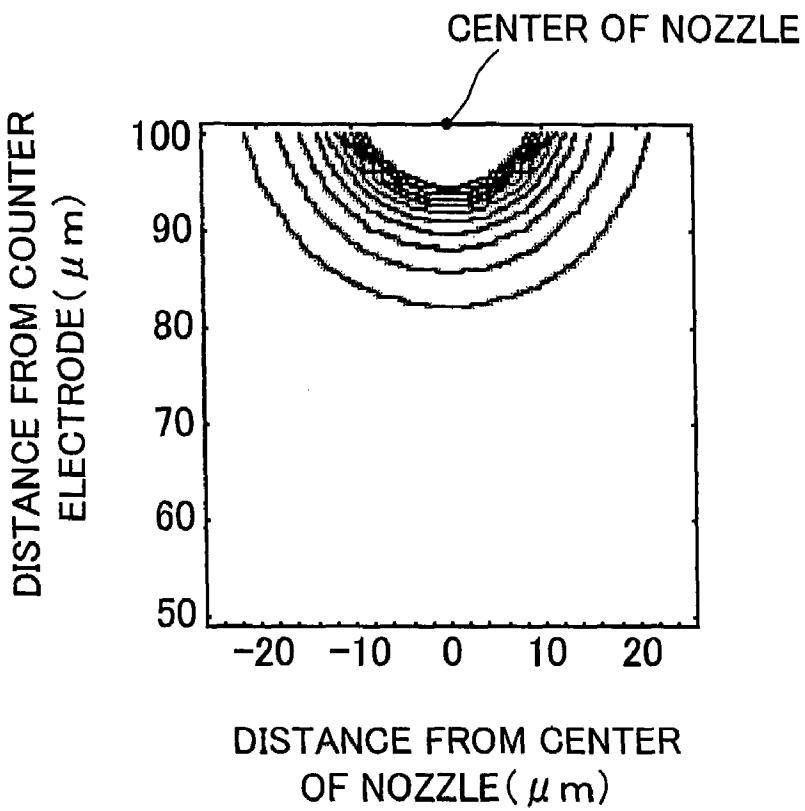

According to these, when the nozzle diameter is equal to or less than Φ8 μm (see FIGS. 6(*a*) and 6(*b*)), the electric field intensity concentrates and the change of the distance of the counter electrode almost never influence the distribution of the electric field intensity. Therefore, when the nozzle diameter is equal to or less than Φ8 μm, it becomes possible to stably carry out the ejection without being influenced by the positioning accuracy of the counter electrode, the variation of the material characteristics of the printing medium and the variation of the thickness of the printing medium. Here, in order to eject the ink 2 whose amount is 1 pl, the nozzle diameter needs to be Φ10 μm. Therefore, when the nozzle diameter is equal to or less than 8 μm, it is possible to eject the ink 2 whose amount is equal to or less than 1 pl.

Figure 9:
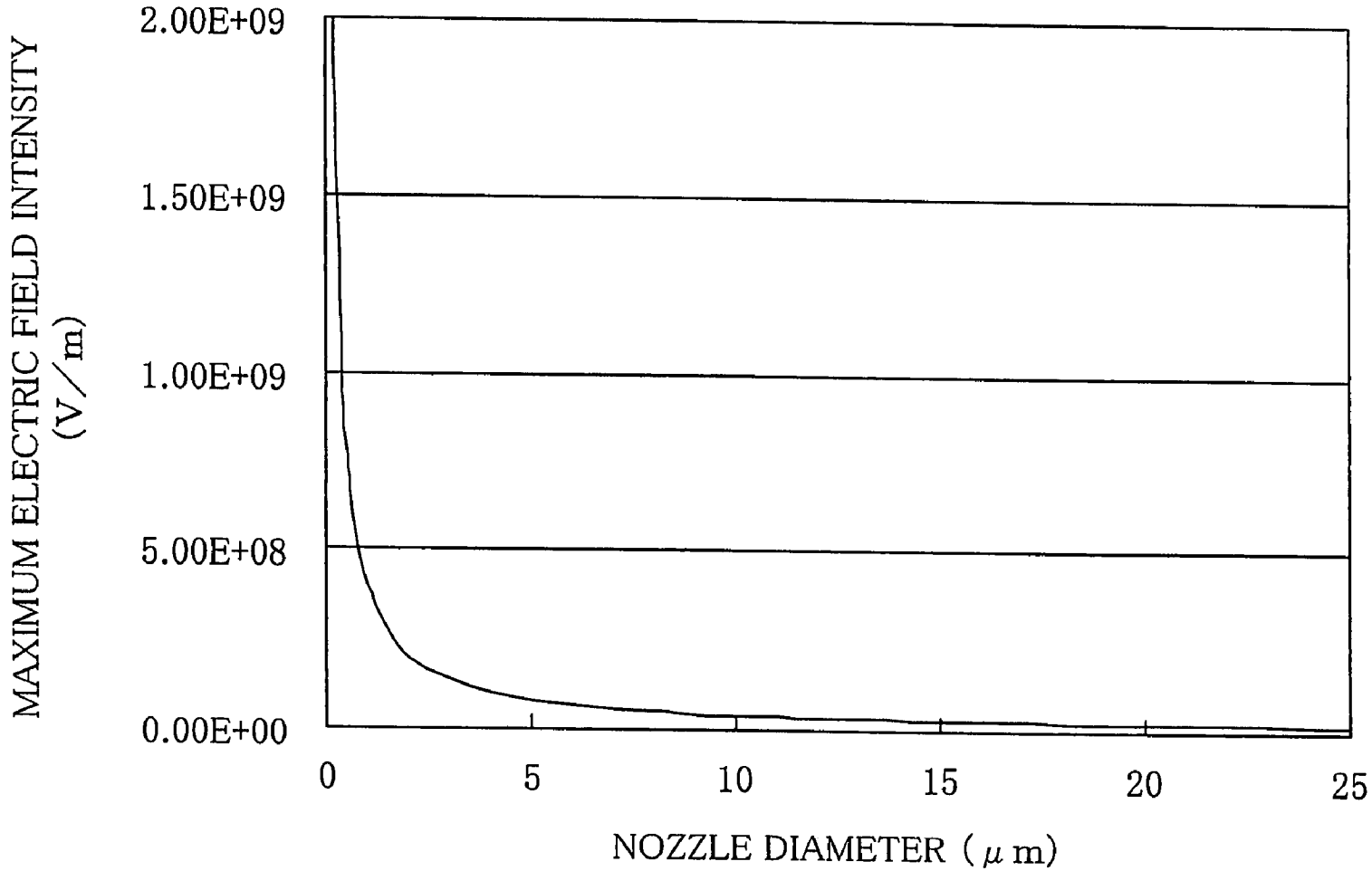
FIG. 9 is a graph illustrating a relationship between a nozzle diameter and a maximum electric field intensity.

Next, FIG. 9 illustrates the relationship of the nozzle diameter of the nozzle 4, the maximum electric field intensity at the meniscus portion 14, and the high electric field region.

It is clear from the graph of FIG. 9 that, when the nozzle diameter is equal to or less than Φ4 μm, it is possible to increase the maximum electric field intensity because the electric field is concentrated extremely. Therefore, it becomes possible to increase the velocity of the initially ejected droplet of the ink. On this account, the stability of the flying ink (droplet) increases and the moving velocity of the electric charge at the meniscus portion increases. As a result, the response of ejection is improved.

Next, the following description explains the maximum amount of electric charge which can be electrified in the droplet 3 of the ink 2 ejected. The amount of electric charge, which can be electrified in the droplet 3, is expressed by Equation (5) which takes Rayleigh split (Rayleigh limit) of the droplet 3 into consideration.

$$q=8\times\pi\times(\epsilon0\times\gamma\times r^3)^{1/2}, \quad (5)$$

where q is the amount of electric charge which gives Rayleigh limit, ϵ0 is a dielectric constant in a vacuum, γ is a surface tension energy of ink, and r is a radius of an ink droplet.

The closer the amount q of electric charge, which can be obtained by Equation (5), is to the value of Rayleigh limit, the stronger the electrostatic force becomes, even when the electric field intensity is constant. Therefore, it is possible to improve the stability of ejection. However, when the amount q is too close to the value of Rayleigh limit, the ink 2 may scatter at the ink-ejecting hole 4*b* of the nozzle 4. This results in lack of the stability of ejection.

Figure 10:
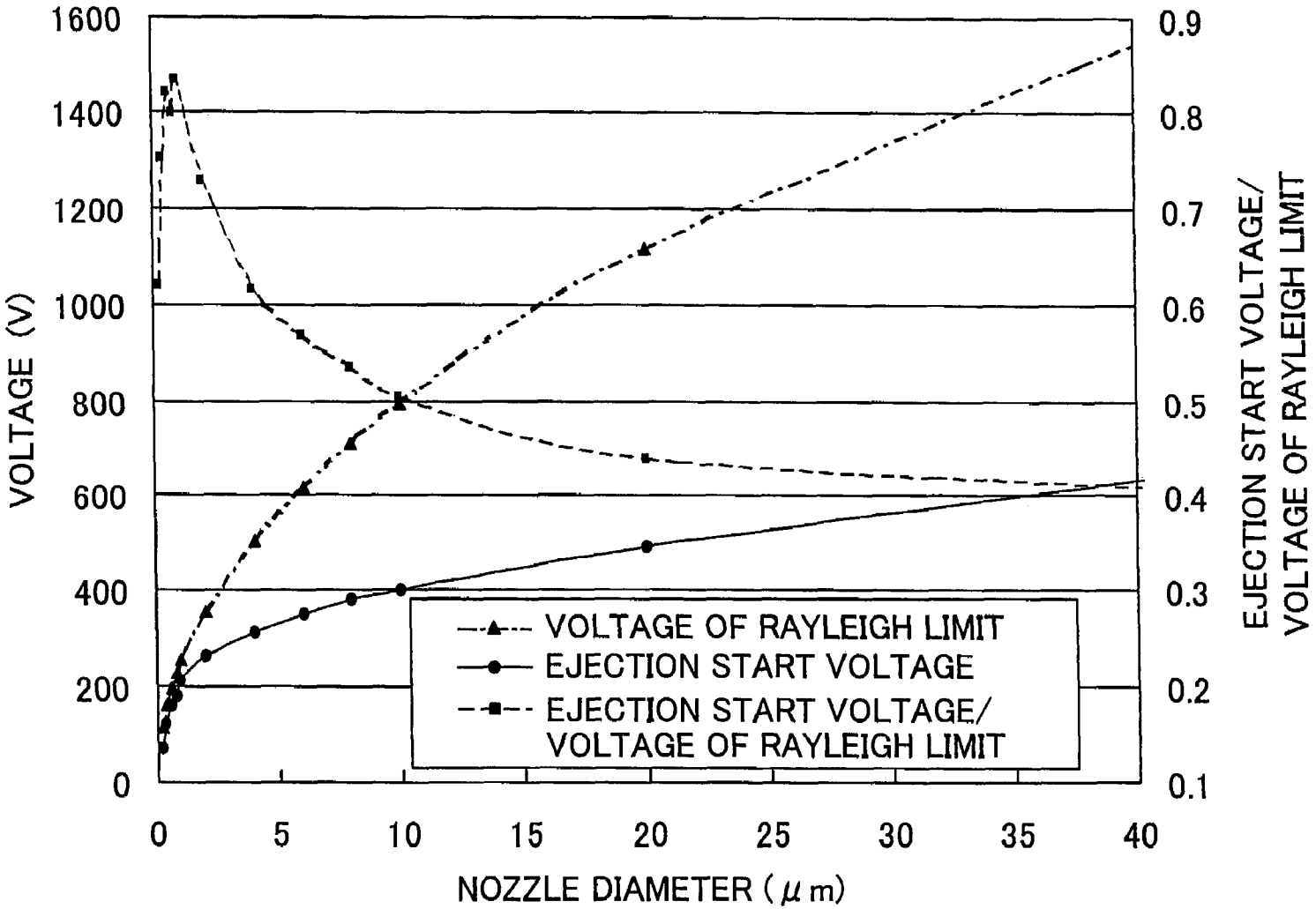
FIG. 10 is a graph illustrating a relationship between a nozzle diameter and each of various voltages.

Here, FIG. 10 is a graph illustrating (i) the relationship between the nozzle diameter of the nozzle and an ejection starting voltage at which an initially ejected droplet, whose diameter is twice as much as the nozzle diameter, and which is ejected at the meniscus portion, starts to fly, (ii) the relationship between the nozzle diameter of the nozzle and the value of a voltage of the initially ejected droplet at Rayleigh limit, and (iii) the relationship between the ratio of the ejection starting voltage to the value of the voltage of Rayleigh limit.

According to the graph of FIG. 10, when the nozzle diameter is from Φ0.2 μm to Φ4 μm, the ratio of the ejection starting voltage to the value of the voltage of Rayleigh limit is over 0.6. Moreover, the electrification efficiency of the droplet is good. Thus, it is clear that it is possible to carry out the ejection stably when the nozzle diameter is as above.

Figure 11:
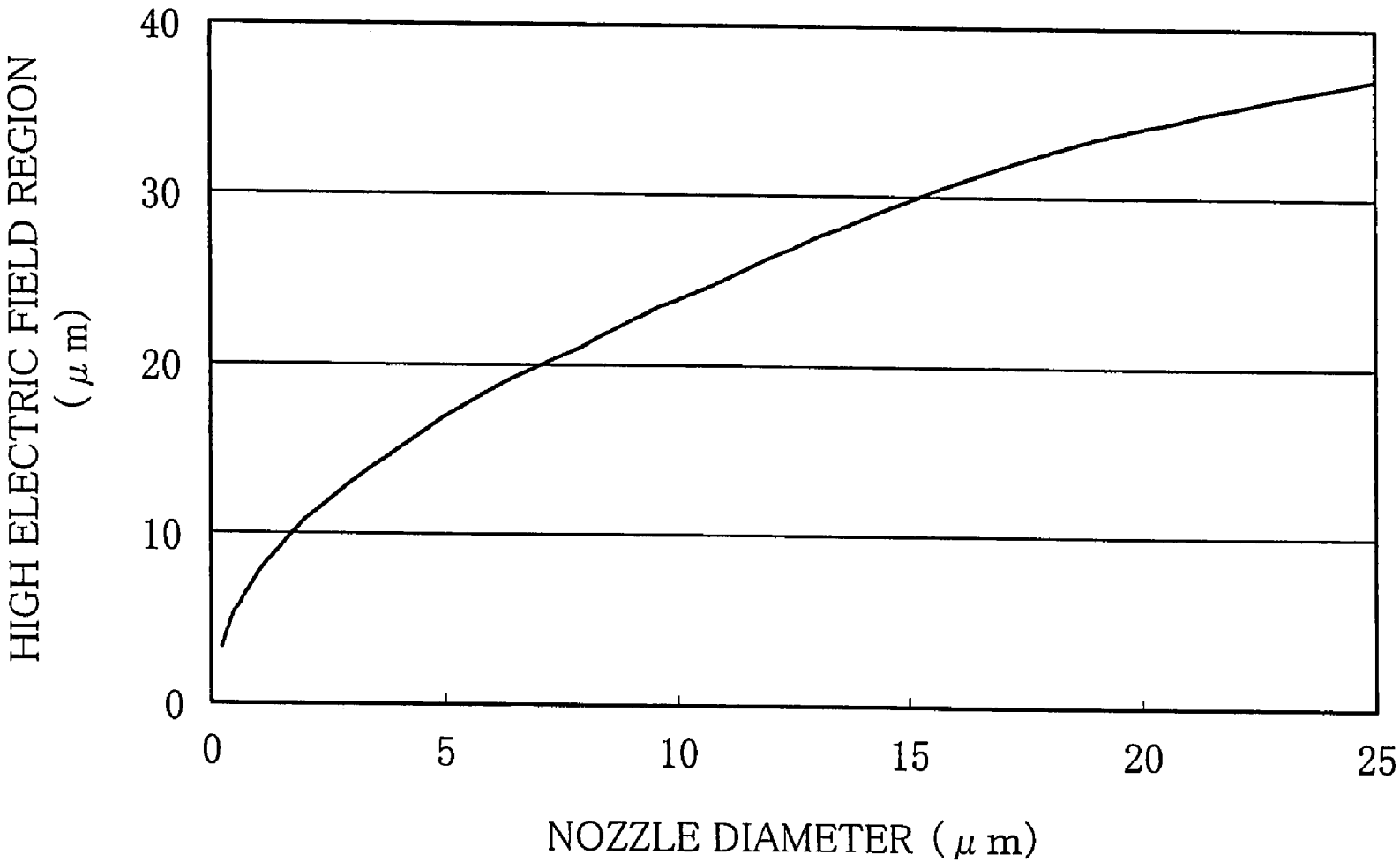
FIG. 11 is a graph illustrating a relationship between a nozzle diameter and a high electric field region.

For example, according to the graph of FIG. 11 which illustrates the relationship between the nozzle diameter and the high electric field (not less than $1\times10^6$ V/m) region at the meniscus portion, the region where the electric field is concentrated becomes extremely small when the nozzle diameter is equal to or less than Φ0.2 μm. According to this, it is not possible to impart enough energy to the ejected droplet, so that the stability of the flying ink is decreased. Therefore, the nozzle diameter needs to be longer than Φ0.2 μm.

Figure 12:
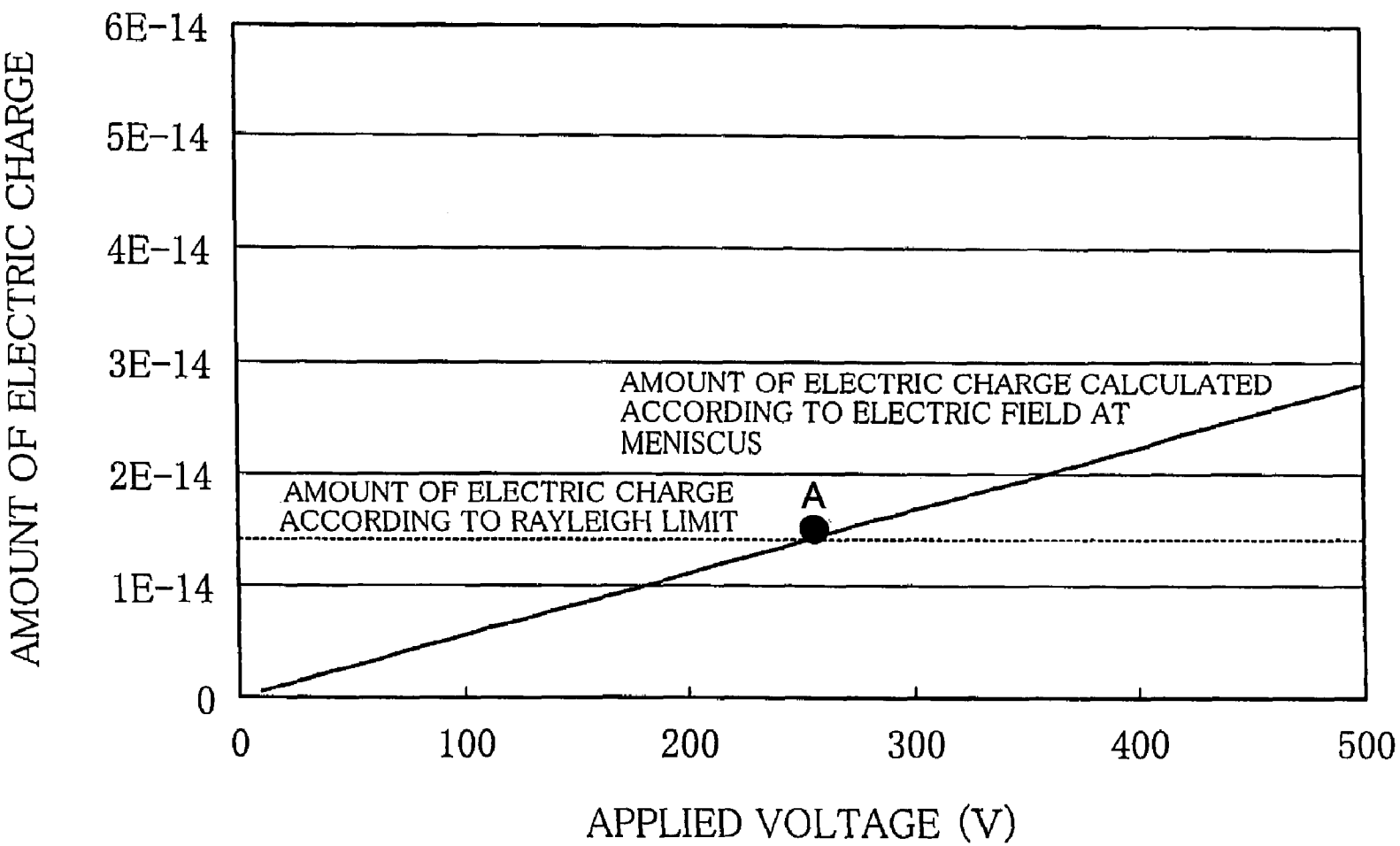
FIG. 12 is a graph illustrating a relationship between an applied voltage and an amount of electric charge electrified.

Next, FIG. 12 is a graph showing a relationship between (i) the amount of electric charge of an initially ejected droplet stably ejected from the meniscus portion induced by the maximum intensity electric field corresponding to the optimal value of the voltage obtained by varying an applied voltage for actually driving the inkjet device arranged as above, that is, a voltage equal to or more than the ejection starting voltage of the droplet and (ii) the value of Rayleigh limit according to the surface tension energy of the droplet.

In the graph of FIG. 12, the point A is an intersection point of the amount of electric charge of the droplet and the value of Rayleigh limit according to the surface tension energy of the droplet. When a voltage applied to ink is higher than the point A, the maximum amount of electric charge, which is close to the value of Rayleigh limit, is generated in the initially ejected droplet. When a voltage applied to ink is lower than the point A, the amount of electric charge, which is not more than the value of Rayleigh limit and is required for the ejection, is generated.

Here, when focusing only on the motion equation of the ejected droplet, the droplet is ejected under the best condition of the ejection energy which is the high electric field and the maximum amount of electric charge, so that it is preferable that an applied voltage be higher than the point A.

Figure 13:
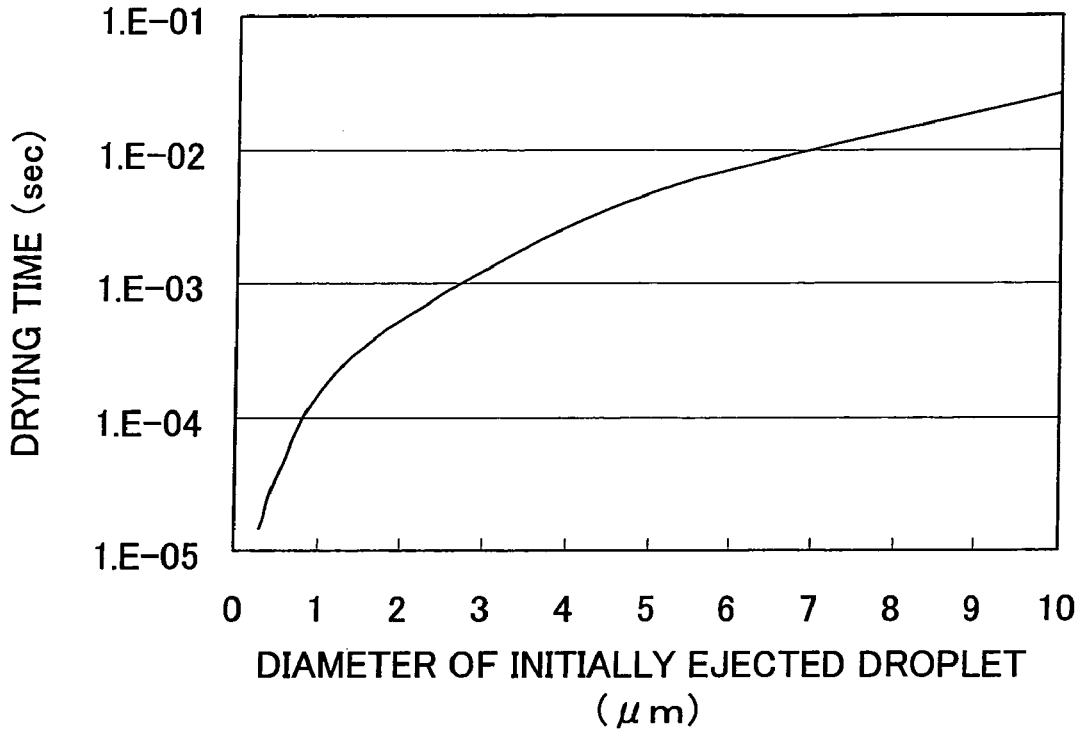
FIG. 13 is a graph illustrating a relationship between a diameter of an initially ejected droplet and a drying time.

Incidentally, FIG. 13 is a graph illustrating a relationship between a diameter of an initially ejected droplet of ink (in this case, purified water) and a drying time (time for all the solvent in a droplet to be vaporized) under the environmental humidity of 50%. According to the graph, it is clear that, when the diameter of the initially ejected droplet is short, the change in the droplet diameter of the ink rapidly occurs because of vaporization and the droplet vaporizes while the droplet is flying, that is, even in a short period of time.

On this account, in the case in which the maximum amount of electric charge is generated in the droplet when the initial ejection is carried out, the droplet diameter decreases because the droplet is dried, that is, the surface area, in which the electric charge is generated, of the droplet decreases. Therefore, Rayleigh split occurs while the ink is flying. When the droplet releases the excessive electric charge, the electric charge is released with a part of the droplet. As a result, the flying droplet decreases more seriously than vaporization.

Therefore, the droplet diameter of the landed droplet is inconsistent and the positioning accuracy deteriorates. Moreover, mist of the droplet floats in the nozzle and on the printing medium, so that the printing medium is contaminated. Therefore, in consideration of the stable formation of ejected dots, the amount of electric charge induced to the initially ejected droplet needs to be a little less than the amount of electric charge corresponding to Rayleigh limit. When the amount of electric charge is 95% of the amount of electric charge corresponding to Rayleigh limit, it is impossible to improve the accuracy of the dot diameter of the landed droplet. Therefore, It is preferable that the amount of electric charge be equal to or less than 90% of the amount of electric charge corresponding to Rayleigh limit.

As a concrete value, first, it is necessary to calculate the value of Rayleigh limit of the initially ejected droplet, whose diameter is determined according to the maximum electric field intensity, of the meniscus when the nozzle hole is considered as the tip shape of the stylus electrode. Then, by setting the amount of electric charge to be equal to or less than the value thus calculated, it is possible to suppress the inconsistency in the diameter of the landed droplet. This may be because (i) the surface area of the ejected droplet which is about to split is smaller than that of the droplet which has just been ejected, and (ii) the amount of electric charge induced to the initially ejected droplet is in reality less than the amount of electric field obtained by the above calculation due to the time lag of the amount of time for the electric charge to move.

Under these conditions, it is possible to prevent Rayleigh split while the droplet is flying. Moreover, it is possible to reduce the unstable ejection, such as the generation of the mist which is caused because the amount of electric charge is too much when the ejected droplet (Rayleigh) splits at the meniscus portion.

Note that, because the vapor pressure decreases, the electrified becomes to hardly vaporize. This is clear from Equation (6) below.

$$RT\rho/M\times\log(P/P0)=2\gamma/d-q^2/(8\pi d^4), \quad (6)$$

where R is a gas constant, M is a molecular weight of a gas, T is a gas temperature, ρ is a gas density, P is a vapor pressure of a minute droplet, P0 is a vapor pressure on a plane surface, γ is a surface tension energy of ink, and d is a radius of an ink droplet.

As expressed by Equation (6), the vapor pressure of the electrified droplet decreases according to the amount of electric charge of the droplet. When the amount of electric charge is too small, it is not effective to suppress the vaporization. It is preferable that the amount of electric charge be equal to or more than 60% of the electric field intensity and the voltage value corresponding to Rayleigh limit. This result is the same as the following: first, the value of Rayleigh limit of the initially ejected droplet, whose diameter is determined according to the maximum electric field intensity, of the meniscus when the nozzle hole is considered as the tip shape of the stylus electrode; and the amount of electric charge is set to be equal to or more than 0.8 times the value thus calculated.

Especially, as illustrated in FIG. 13, when the diameter of the initially ejected droplet is equal to or less than Φ5 μm, the drying time becomes extremely short, and the droplet is easily influenced by the vaporization. Therefore, in order to suppress the vaporization, it is effective to suppress the amount of electric charge of the initially ejected droplet. Note that, the environmental humidity is 50% when the relationship between the drying time and the diameter of the initially ejected droplet illustrated in FIG. 13 is obtained.

Moreover, in consideration of the drying of the ejected droplet, it is necessary of shorten the amount of time for ejecting the fluid onto the printing medium.

Here, Table 3 below shows results of comparison of the stability of ejection and the positioning accuracy of the landed dot when the average velocity of the ejected droplet, which is separated from the meniscus portion so as to fly from the nozzle to the printing medium, is 5 m/s, 10 m/s, 20 m/s, 30 m/s, 40 m/s, or 50 m/s.

TABLE 3

| DIAMETER OF INITIALLLY EJECTED | Φ0.4 μm | | Φ1 μm | | Φ3 μm | |
|---|---|---|---|---|---|---|
| DROPLET AVERAGE VELOCITY | STABILITY OF EJECTION | POSITIONING ACCURACY | STABILITY OF EJECTION | POSITIONING ACCURACY | STABILITY OF EJECTION | POSITIONING ACCURACY |
| 5 m/s | X(DIDN'T LAND ON) | | Δ | Δ | ○ | Δ |
| 10 m/s | ○ | ○ | ○ | ○ | ○ | ○ |
| 20 m/s | ○ | ◎ | ○ | ◎ | ○ | ◎ |
| 30 m/s | ○ | ◎ | ○ | ◎ | ○ | ◎ |
| 40 m/s | ○ | ◎ | ○ | ◎ | ○ | ◎ |
| 50 m/s | X(MIST GENERATED) | | X(MIST GENERATED) | | X(MIST GENERATED) | |

Marks concerning STABILITY OF EJECTION in Table 3 indicate as follows: x indicates that the ink is hardly ejected, Δ indicates that the ink may not be ejected when the ink is continuously ejected, and ○ indicates that the ink is stably ejected. Marks concerning POSITIONING ACCURACY in Table 3 indicate as follows: x indicates that landing gap>dot diameter of landed droplet, Δ indicates that landing gap>dot diameter of landed droplet×0.5, ○ indicates that landing gap<dot diameter of landed droplet×0.5, ◎ indicates that landing gap<dot diameter of landed droplet×0.2.

As is clear from Table 3, when the average velocity is 5 m/s, the positioning accuracy and the stability of ejection deteriorate. Especially, in the case in which the nozzle diameter is equal to or less than Φ1 μm, when the velocity of the ejected droplet is low, the air resistance with respect to the droplet is high and the dot diameter is further decreased by vaporization. On this account, the droplet may not land. In contrast, in the case in which the average velocity is 50 m/s, it is necessary to increase the applied voltage. Therefore, the electric field intensity at the meniscus portion becomes very high, so that the mist of the ejected droplet is generated frequently. Therefore, it is difficult to eject the droplet stably.

According to the above, it is clear that it is preferable that the average velocity of the droplet, which is separated from the meniscus portion so as to land on the printing medium, be from 10 m/s to 40 m/s.

Incidentally, FIG. 13 illustrates a relationship between the diameter of the initially ejected droplet and the drying time when the environmental humidity is 50%. Meanwhile, FIG. 14 illustrates a relationship between the environmental humidity and the drying time when the diameter of the initially ejected droplet is Φ0.5 μm and a distance between the nozzle and the printing medium is 0.2 mm.

Figure 14:
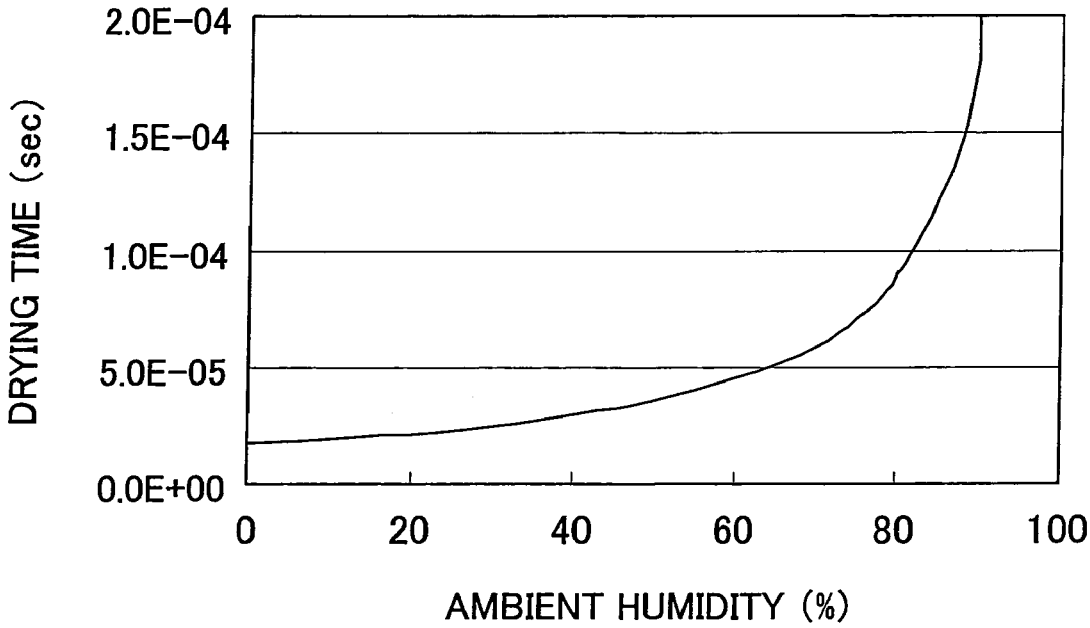
FIG. 14 is a graph illustrating a relationship between ambient humidity and a drying time.

According to the graph of FIG. 14, it is clear that the drying velocity does not change significantly when the environmental humidity is equal to or less than 60%. However, when the environmental humidity is over 70%, it is possible to dramatically suppress the vaporization of the ink. When the environmental humidity is equal to or more than 70%, the influence of the above conditions becomes little. Especially, when the environmental humidity is equal to or more than 95%, it is clear that it is possible to (i) substantially neglect the influence of the drying, (ii) increase the freedom of the designing of the ink jet device of the present invention and (iii) increase the applicability of the ink jet device of the present invention.

Here, Table 4 below shows the stability of ejection and variation of the dot diameter of the ejected droplet (variation of the landed droplet) when (i) the nozzle diameter is Φ1 μm or Φ3 μm and (ii) the diameter of the initially ejected droplet varies. Note that, it is possible to control the diameter of the initially ejected droplet from the nozzle by changing the value of the applied voltage. Moreover, it is also possible to control the diameter by adjusting the pulse width of the applied voltage pulse. Here, in order to remove the influence of the electric field intensity when using the nozzles whose diameters are the same with each other, the diameter of the initially ejected droplet is adjusted by changing the pulse width.

Marks concerning STABILITY OF EJECTION in Table 4 indicate as follows: x indicates that the ink is hardly ejected, Δ indicates that the ink may not be ejected when the ink is continuously ejected for 10 minutes, ○ indicates that the ink is stably ejected even when the ink is continuously ejected for 10 minutes, ◎ indicates that the ink is stably ejected even when the ink is continuously ejected for 30 minutes. Marks concerning VARIATION indicate as follows: Δ indicates that landing dot variation>dot diameter of landed droplet×0.2, ○ indicates that landing dot variation≦dot diameter of landed droplet×0.2, ◎ indicates that landing dot variation≦dot diameter of landed droplet×0.1.

According to Table 4, when the diameter of the initially ejected droplet is substantially from 1.5 times to 3 times longer than the nozzle diameter, it is clear that the stability of ejection is favorable. Especially, when the diameter of the initially ejected droplet is from 1.5 times to twice longer than the nozzle diameter, variation of the dot diameter of the landed droplet is suppressed dramatically. This is because the droplet separates most stably under the condition that, when the shape of the ink separated from the meniscus portion is assumed as a liquid column, the surface area of the liquid column is larger than the surface area of a globe whose volume is the same as that of the liquid column.

According to the above arrangement, in an electrostatic attraction ink jet device which ejects a minute ink droplet whose amount of the ink, which has just been ejected, is equal to or less than 1 pl, the diameter of the ink-ejecting hole 4*b* of the nozzle 4 is set to be equal to or less than the diameter of the droplet of the ink which has just been ejected. In this way, it is possible to concentrate the electric field, which is used for the ejection, on the meniscus portion 14 of the nozzle 4. Therefore, it is possible to dramatically decrease the applied voltage required for ejecting the ink. As a result, it is possible to suppress variation of the diameter of the droplets which are separated and ejected one by one, and also possible to stably eject the droplets.

In addition, it becomes unnecessary to apply the bias voltage which is conventionally needed. Therefore, it becomes possible to alternately apply the positive and negative drive voltages. It is also possible to prevent an increase in the surface potential of the printing medium from influencing on the positioning accuracy.

Moreover, by setting the nozzle hole diameter to be equal to or less than Φ8 μm, it is possible to concentrate the electric field on the meniscus portion of the nozzle. It is also possible to stably eject droplets without being influenced by the positioning accuracy of the counter electrode, variation of the material characteristics of the printing medium, and variation of the thickness.

Especially, when the diameter of the ink-ejecting hole 4*b* of the nozzle 4 is not less than Φ0.2 μm and not more than Φ4 μm, the electric field concentrates extremely. Thus, increasing the maximum electric field intensity increases the velocity of the initially ejected droplet of the ink. Therefore, the stability of the flying ink increases and the moving velocity of the electric charge increases at the meniscus portion. As a result, the response of ejection is improved and it is possible to suppress variation, which is caused by the influence of Rayleigh split, of dot diameter of the landed droplet.

TABLE 4

| DIAMETER OF | NOZZLE DAIMETER (μm) | | | | | |
|---|---|---|---|---|---|---|
| INITIALLLY EJECTED | Φ1 | | Φ3 | | Φ5 | |
| DROPLET DROPLET (μm) | VARIATION | STABILITY OF EJECTION | VARIATION | STABILITY OF EJECTION | VARIATION | STABILITY OF EJECTION |
| Φ1 | Δ | ○ | | X | | X |
| Φ1.5 | ◎ | ◎ | | X | | X |
| Φ2 | ◎ | ◎ | | X | | X |
| Φ3 | ◎ | ○ | Δ | Δ | | X |
| Φ5 | ○ | Δ | ◎ | ◎ | Δ | Δ |
| Φ7 | | X | ◎ | ○ | ◎ | ○ |
| Φ10 | | X | Δ | ○ | ◎ | ◎ |
| Φ15 | | X | Δ | Δ | ○ | ○ |
| Φ20 | | X | | X | ○ | Δ |

Furthermore, the diameter of the droplet, which has just been ejected from the nozzle 4, is set so as to be from 1.5 times to 3 times longer than the diameter of the ink-ejecting hole 4*b* of the nozzle 4. In this way, it is possible to improve the stability of ejection. Especially, when the diameter of the droplet, which has just been ejected, is set to be from 1.5 times to twice longer than the nozzle diameter, it is possible to extremely suppress variation of the dot diameter of the landed droplet.

Figure 15:
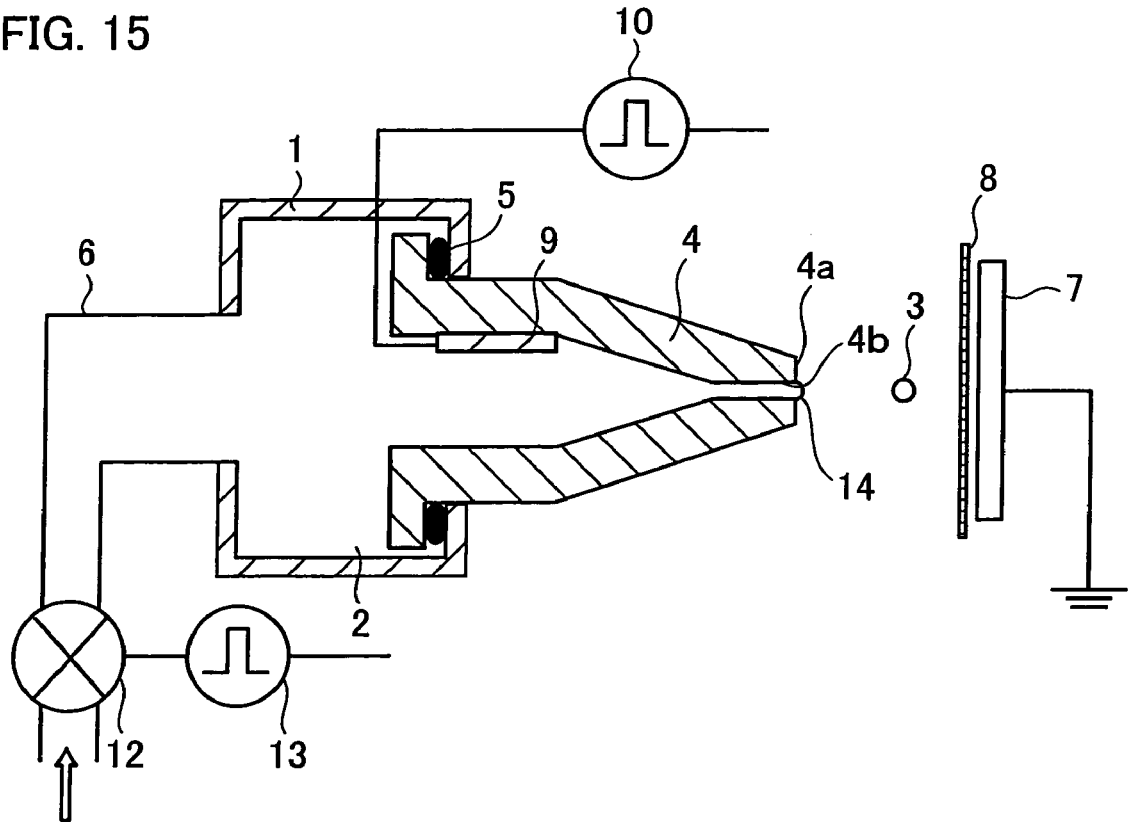
FIG. 15 is a cross-sectional view illustrating a schematic arrangement of an ink jet device in accordance with another embodiment of the present invention.
Figure 16:
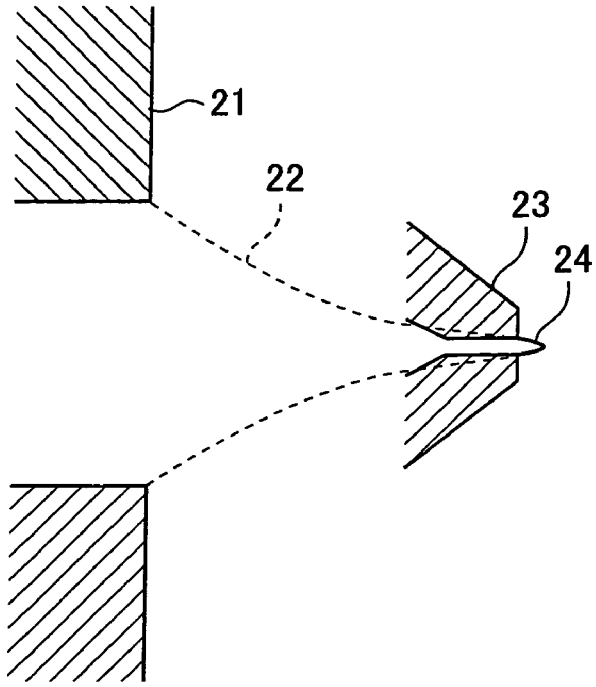
FIG. 16 is a diagram for explaining a principle of the present invention.
Figure 17:
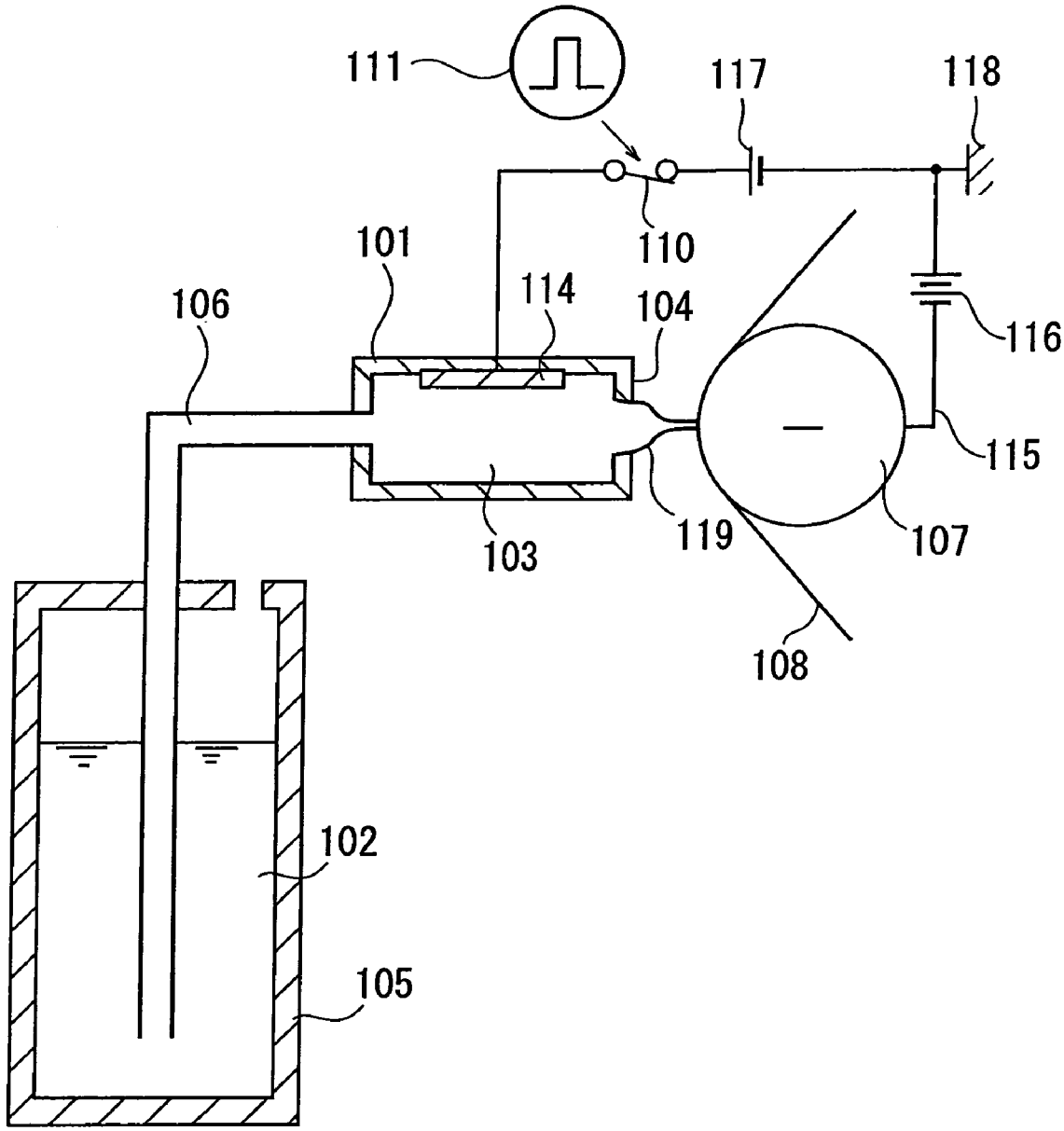
FIG. 17 is a cross-sectional view illustrating an outline of a conventional electrostatic attraction ink jet device.
Figure 18:
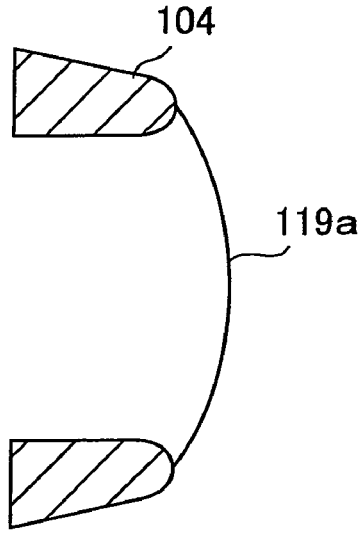
FIGS. 18(*a*) to 18(*c*) are diagrams for explaining movements of a meniscus of ink in the ink jet device illustrated in FIG. 17.
Figure 18:
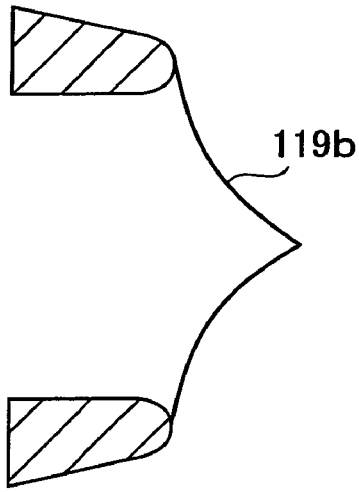
Figure 18:
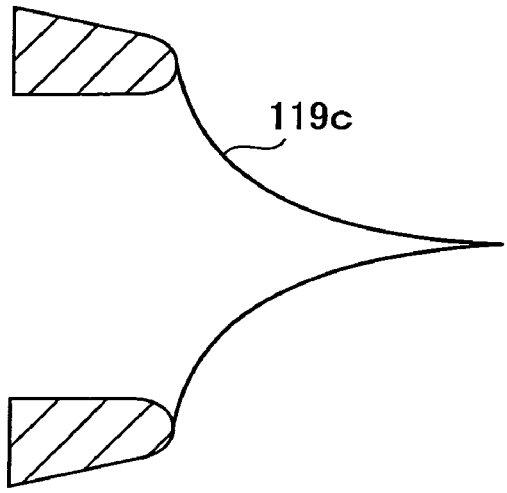
Figure 19:
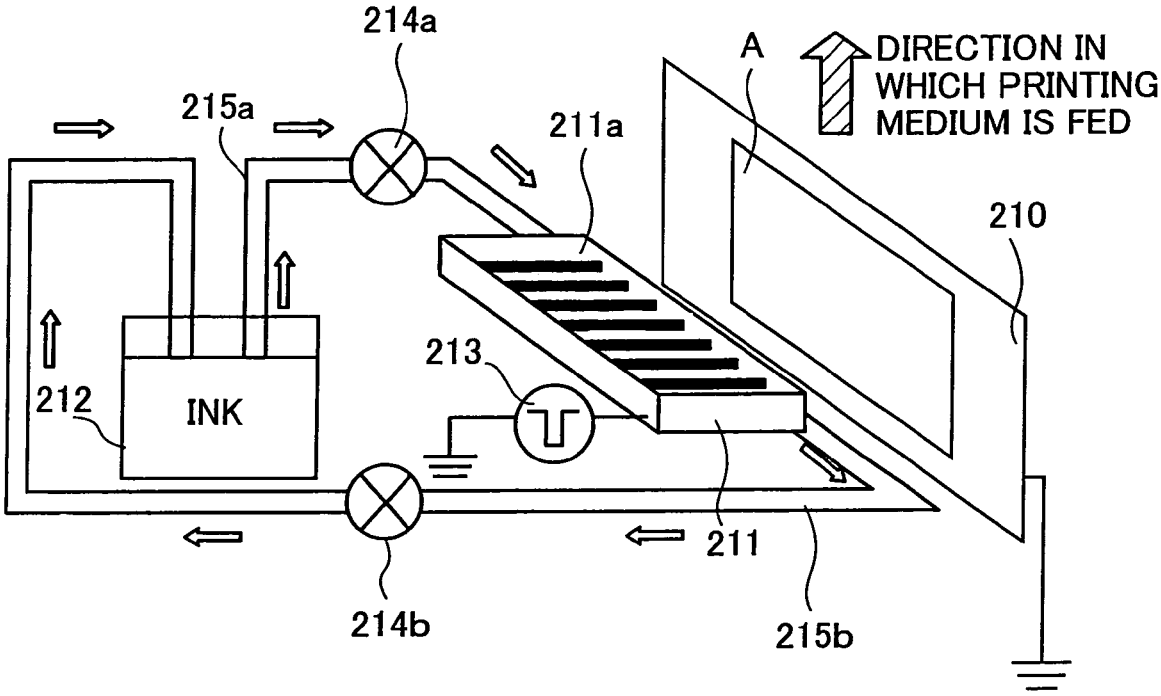
FIG. 19 is a view illustrating a schematic arrangement of another conventional electrostatic attraction ink jet device.
Figure 20:
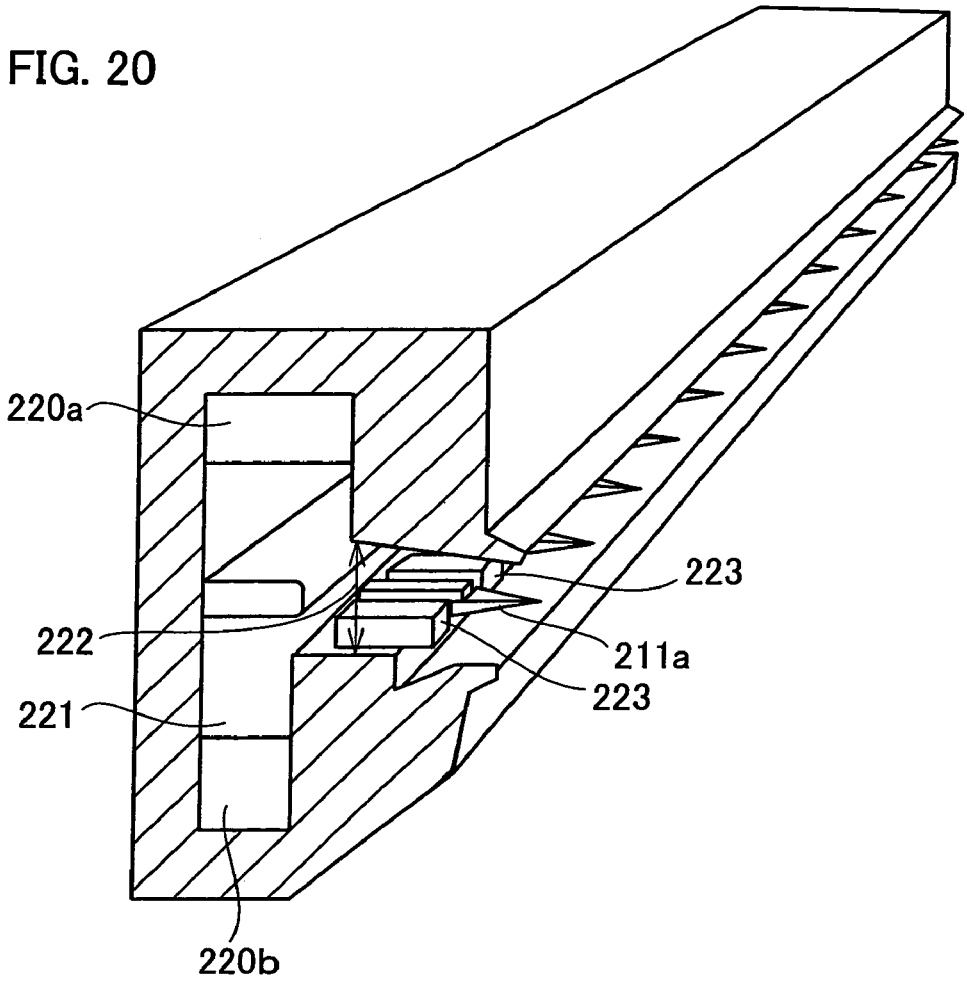
FIG. 20 is a schematic perspective cross section of a nozzle portion in the ink jet device illustrated in FIG. 19.
Figure 21:
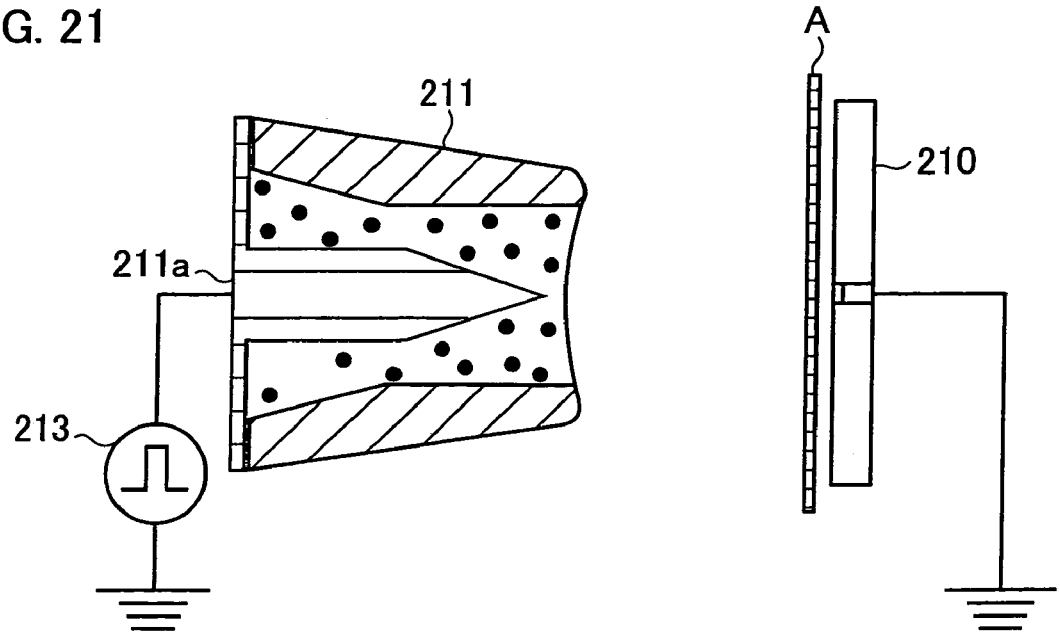
FIG. 21 is a diagram for explaining a principle of an ink ejection of the ink jet device illustrated in FIG. 19.
Figure 22:
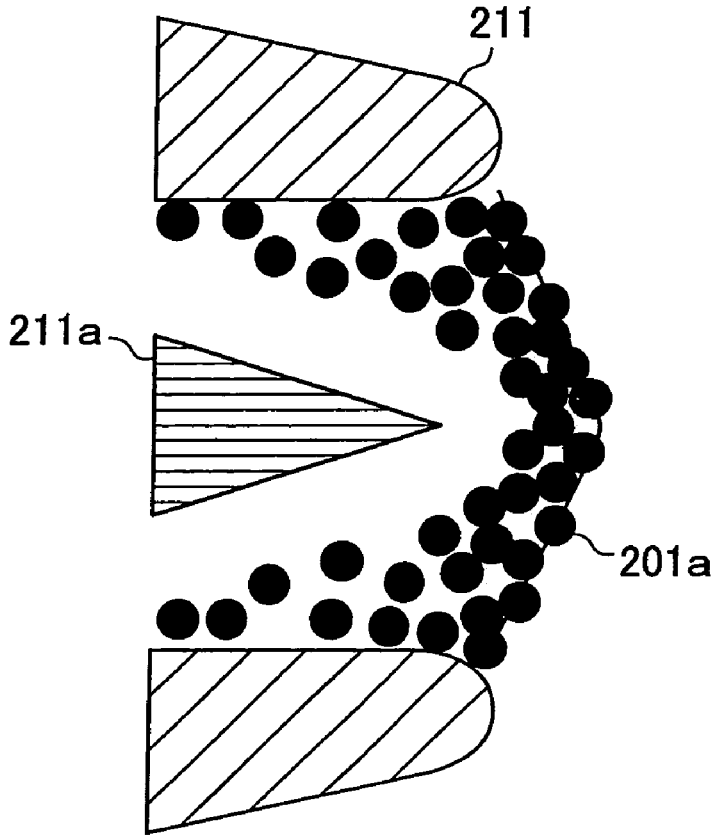
FIG. 22 is a diagram for explaining a state of fine particles, when a voltage is applied, at a nozzle portion of the ink jet device illustrated in FIG. 19.
Figure 23:
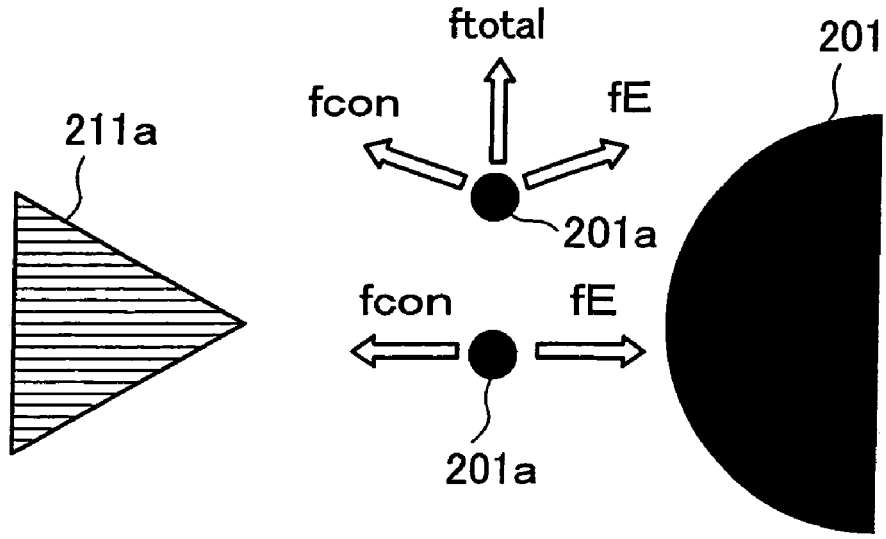
FIG. 23 is a diagram for explaining a principle for forming an aggregate of fine particles at a nozzle portion of the ink jet device illustrated in FIG. 19.
Figure 24:
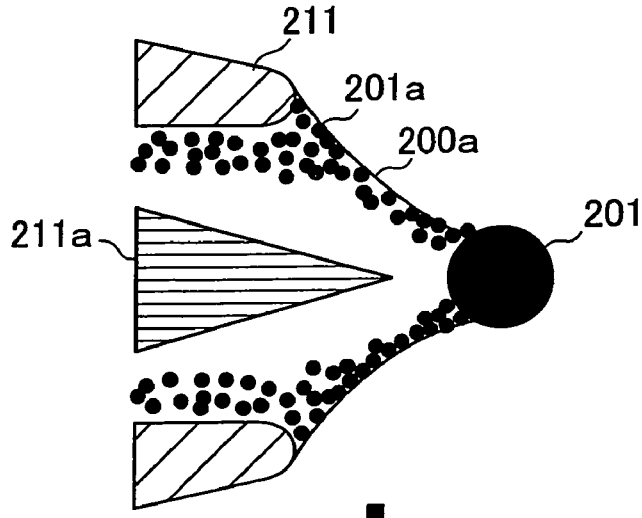
FIGS. 24(*a*) to 24(*c*) are diagrams for explaining movements of a meniscus of ink in the ink jet device illustrated in FIG. 19.
Figure 24:
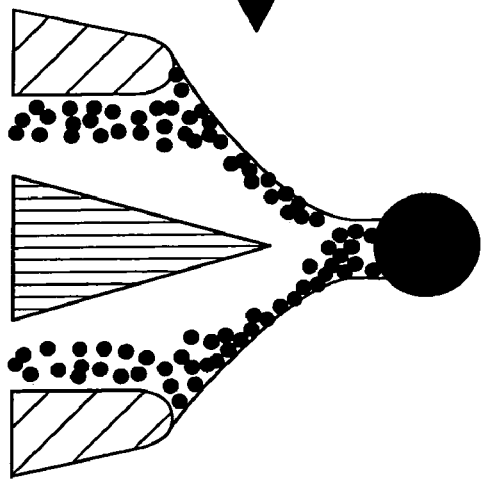
Figure 24:
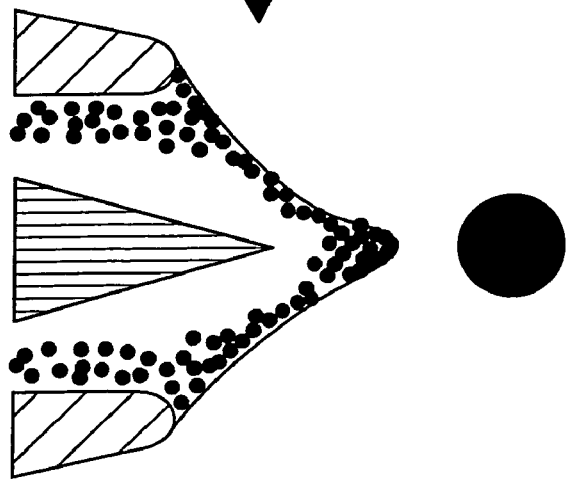

As above, the present embodiment explained a case in which the negative pressure is applied to the ink in the ink chamber 1. However, the positive pressure may be applied to the ink in the ink chamber 1. As illustrated in FIG. 15, in order to apply the positive pressure to the ink in the ink chamber 1, for example, a pump 12 is provided on the ink tank (not illustrated) side of the ink supplying path 6 so that the positive pressure can be applied to the ink in the ink chamber 1 by using the pump 12. In this case, the process control section 13 controls the pump 12 so that the pump 12 is driven in synchronism with the timing of the ink ejection from the ink chamber 1. Thus, by applying the positive pressure to the ink in the ink chamber 1, it becomes unnecessary to form the projection of the meniscus portion by the electrostatic force. Therefore, it is possible to reduce the applied voltage and improve the response velocity.

Note that, for ease of explanation, the present embodiment explained an ink jet device provided with a single nozzle. However, the present invention is not limited to this. When the designing is carried out in consideration of the influence of the electric field between the nozzles adjacent to each other, it is possible to apply the present invention to an ink jet device provided with a multi head having a plurality of nozzles.

Furthermore, as illustrated in FIGS. 1 and 15, the present embodiment explained an ink jet device provided with the counter electrode. However, as is clear from Table 2, the distance (gap) between the counter electrode 7 and the ink-ejecting hole 4*b* of the nozzle 4 hardly influences the intensity of the electric field between the printing medium and the nozzle. Therefore, when the distance between the printing medium and the nozzle is short and the surface potential of the printing medium is stable, the counter electrode is unnecessary.

As described above, the electrostatic attraction fluid jet device of the present invention ejects a fluid, which is electrified by a voltage application, by an electrostatic attraction in the form of a droplet from a fluid-ejecting hole of a nozzle made of an insulating material, wherein a diameter of the fluid-ejecting hole of the nozzle is equal to or less than a diameter of the droplet, which has just been ejected, of the fluid.

Therefore, it becomes possible to decrease the size of the electric field, which is conventionally large, by causing the nozzle diameter to be substantially equal to the diameter of the tip portion where the taylor-cone-shaped electric charge for ejecting a fluid whose droplet diameter is shorter than the diameter of the fluid-ejecting hole of the conventional nozzle is concentrated, in the conventional process of the electrostatic attraction of the fluid.

In addition, because the diameter of the fluid-ejecting hole of the nozzle is equal to or less than the droplet diameter of the fluid which has just been ejected, it is possible to equalize in size the region where the electric charge is concentrated and the meniscus region of the fluid.

According to the above, it is possible to drastically reduce the voltage required for the movement of the electric charge, that is, the voltage required for applying to the fluid the electric charge whose amount is such that the fluid is electrostatically attracted so as to be ejected in the form of a droplet having a desired diameter. On this account, it is not necessary to apply a high voltage of 2,000 V which is conventional necessary. As a result, it is possible to improve safety when a fluid jet device is used.

Moreover, because it is possible to reduce the area of the electric field as described above, it becomes possible to generate a high electric field in a small region. As a result, it becomes possible to form minute droplets. On this account, when the droplet is made of ink, it becomes possible to realize a high resolution printed image.

Further, because the region where the electric charge is concentrated and the meniscus region of the fluid become substantially the same in size, the amount of time for the electric charge to move in the meniscus region does not influence the response of ejection. As a result, it is possible to improve the velocity of the ejected droplet (print speed when the droplet is ink).

Moreover, because the region where the electric charge is concentrated and the meniscus region of the fluid becomes substantially the same in size, it becomes unnecessary to generate a high electric field in a large meniscus region. Therefore, unlike the conventional arrangements, it becomes unnecessary to accurately place the counter electrode in order to generate the high electric field in the large meniscus region. In addition, the dielectric constant and the thickness of the printing medium do not influence the positioning of the counter electrode any more.

Therefore, in the electrostatic attraction fluid jet device, the freedom of the positioning of the counter electrode increases. That is, the freedom of the designing of the electrostatic attraction fluid jet device increases. As a result, it becomes possible to print to a printing medium which is conventionally difficult to use, and possible to realize a fluid jet device which is highly versatile, without being influenced by the dielectric constant or the thickness.

Therefore, according to the electrostatic attraction fluid jet device arranged as above, it is possible to realize a device which has high definition, is safe and is highly versatile.

Moreover, the electrostatic attraction fluid jet device of the present invention ejects a fluid, which is electrified by a voltage application, by an electrostatic attraction in the form of a droplet from a fluid-ejecting hole of a nozzle made of an insulating material, wherein a diameter of the fluid-ejecting hole of the nozzle is equal to or less than Φ8 μm.

Therefore, it becomes possible to decrease the size of the electric field, which is conventionally large, by setting the nozzle diameter so that the nozzle diameter is substantially equal to the diameter of the tip portion, where the electric charge is concentrated, of the taylor cone formed for ejecting a fluid whose droplet diameter is shorter than the diameter of the fluid-ejecting hole of the conventional nozzle, in the conventional process of the electrostatic attraction of the fluid.

According to the above, it is possible to drastically reduce the voltage required for the movement of the electric charge, that is, the voltage required for applying to the fluid the electric charge required for electrostatically attracting the fluid. On this account, it is not necessary to apply a high voltage of 2,000 V which is conventional necessary. As a result, it is possible to improve safety when a fluid jet device is used.

Moreover, because the diameter of the fluid-ejecting hole of the nozzle is equal to or less than Φ8 μm, the intensity distribution of the electric field concentrates near an ejecting surface of the fluid-ejecting hole. Moreover, the change in the distance between the counter electrode and the fluid-ejecting hole of the nozzle does not influence the intensity distribution of the electric field any more.

Therefore, it is possible to eject the fluid stably without being influenced by (i) the positioning accuracy of the counter electrode and (ii) the variation of the material characteristics or the variation of the thickness of the printing medium.

Moreover, because it is possible to reduce the area of the electric field as described above, it becomes possible to generate a high electric field in a small area. As a result, it becomes possible to form minute droplets. On this account, when the droplet is ink, it becomes possible to realize a high resolution printed image.

Furthermore, because the region where the electric charge is concentrated and the meniscus region of the fluid become the same in size, the amount of time for the electric charge to move in the meniscus region does not influence the response of ejection. As a result, it is possible to improve the velocity of the ejected droplet (print speed when the droplet is ink).

Moreover, because the region where the electric charge is concentrated and the meniscus region of the fluid becomes substantially the same in size, it becomes unnecessary to generate the high electric field in the large meniscus region. Therefore, unlike the conventional inventions, it becomes unnecessary to accurately place the counter electrode in order to generate the high electric field in the large meniscus region. In addition, the dielectric constant and the thickness of the printing medium do not influence the positioning of the counter electrode any more.

Therefore, in the electrostatic attraction fluid jet device, the freedom of the positioning of the counter electrode increases. That is, the freedom of the designing of the electrostatic attraction fluid jet device increases. As a result, it becomes possible to print to a printing medium which is conventionally difficult to use, and possible to realize a fluid jet device which is highly versatile, without being influenced by the dielectric constant or the thickness.

Therefore, according to the electrostatic attraction fluid jet device arranged as above, it is possible to realize a device which has high definition, is safe and is highly versatile.

By controlling a voltage applied to the fluid, it is possible to adjust the droplet amount (volume or diameter of the droplet) of the ejected fluid. Therefore, an applied voltage control means which controls the voltage applied to the fluid may be provided in order to cause the droplet amount of the fluid which has just been ejected from the fluid-ejecting hole to be equal to or less than 1 pl.

Moreover, the diameter of the fluid-ejecting hole of the nozzle may be not less than Φ0.2 μm and not more than Φ4 μm.

In this case, because the diameter of the fluid-ejecting hole of the nozzle is not less than Φ0.2 μm and not more than Φ4 μm, the electric field is concentrated extremely. Therefore, it is possible to increase the maximum electric field intensity. As a result, it becomes possible to stably eject a minute droplet whose diameter is short.

The applied voltage control means may control the voltage applied to the fluid so that the diameter of the droplet, which has just been ejected from the fluid-ejecting hole, is from 1.5 times to 3 times longer than the diameter of the fluid-ejecting hole. Further, the applied voltage control means may control the voltage applied to the fluid so that the diameter of the droplet, which has just been ejected from the fluid-ejecting hole, is from 1.5 times to twice longer than the diameter of the fluid-ejecting hole.

In this case, when the diameter of the droplet (diameter of the initially ejected droplet), which has just been ejected from the fluid-ejecting hole, is from 1.5 times to 3 times longer than the diameter of the fluid-ejecting hole, the stability of ejection of the fluid improves. Especially, when the diameter of the droplet, which has just been ejected from the fluid-ejecting hole, is from 1.5 times to twice longer than the diameter of the fluid-ejecting hole, it is possible to dramatically suppress variation of the dot diameter of the landed droplet when the fluid is ejected and landed on the printing medium.

Moreover, the electrostatic attraction fluid jet device of the present invention ejects a fluid, which is electrified by a voltage application, by an electrostatic attraction in the form of a droplet from a fluid-ejecting hole of a nozzle made of an insulating material, wherein an applied voltage control means which controls a voltage applied to the fluid in the nozzle is included, a diameter of the fluid-ejecting hole of the nozzle is equal to or less than Φ8 μm, and the applied voltage control means controls a voltage applied to the fluid so that the amount of electric charge, induced to a droplet of the fluid which droplet has just been ejected from the fluid-ejecting hole, is equal to or less than 90% of the amount of electric charge corresponding to Rayleigh limit of the droplet.

Therefore, it becomes possible to decrease the size of the electric field, which is conventionally large, by setting the nozzle diameter so that the nozzle diameter is substantially equal to the diameter of the tip portion, where the electric charge is concentrated, of the taylor cone formed for ejecting a fluid whose droplet diameter is shorter than the diameter of the fluid-ejecting hole of the conventional nozzle in the conventional process of the electrostatic attraction of the fluid.

According to the above, it is possible to drastically reduce the voltage required for the movement of the electric charge, that is, the voltage required for applying to the fluid the electric charge required for electrostatically attracting the fluid. On this account, it is not necessary to apply a high voltage of 2,000 V which is conventional necessary. As a result, it is possible to improve safety when a fluid jet device is used.

Moreover, because the diameter of the fluid-ejecting hole of the nozzle is equal to or less than Φ8 μm, the intensity distribution of the electric field concentrates near an ejecting surface of the fluid-ejecting hole. Moreover, the change in the distance between the counter electrode and the fluid-ejecting hole of the nozzle does not influence the intensity distribution of the electric field any more.

Therefore, it is possible to eject the fluid stably without being influenced by (i) the positioning accuracy of the counter electrode and (ii) the variation of the material characteristics or the variation of the thickness of the printing medium.

Moreover, because it is possible to reduce the area of the electric field as described above, it becomes possible to generate a high electric field in a small area. As a result, it becomes possible to form minute droplets. On this account, when the droplet is ink, it becomes possible to realize a high resolution printed image.

Furthermore, because the region where the electric charge is concentrated and the meniscus region of the fluid become the same in size, the amount of time for the electric charge to move in the meniscus region does not influence the response of ejection. As a result, it is possible to improve the velocity of the ejected droplet (print speed when the droplet is ink).

Moreover, because the region where the electric charge is concentrated and the meniscus region of the fluid becomes substantially the same in size, it becomes unnecessary to generate the high electric field in the large meniscus region. Therefore, unlike the conventional inventions, it becomes unnecessary to accurately place the counter electrode in order to generate the high electric field in the large meniscus region.

In addition, the dielectric constant and the thickness of the printing medium do not influence the positioning of the counter electrode any more.

Therefore, in the electrostatic attraction fluid jet device, the freedom of the positioning of the counter electrode increases. That is, the freedom of the designing of the electrostatic attraction fluid jet device increases. As a result, it becomes possible to print to a printing medium which is conventionally difficult to use, and possible to realize a fluid jet device which is highly versatile, without being influenced by the dielectric constant or the thickness.

Therefore, according to the electrostatic attraction fluid jet device arranged as above, it is possible to realize a device which has high definition, is safe and is highly versatile.

Here, as the fluid, it is possible to use (i) purified water, (ii) oil, (iii) ink which is a colored fluid containing dyes or pigments as fine particles, (iv) solution containing wiring materials (conductive fine particles, such as silver, copper, etc.) for forming a circuit substrate, etc.

For example, in the case in which the ink is used as the fluid, it is possible to realize high definition printing. In the case in which the solution containing wiring materials for forming the circuit substrate is used as the fluid, it becomes possible to form a super high definition substrate whose line width of the wiring is very narrow. Therefore, in either case, it is possible to eject the fluid stably.

Furthermore, the applied voltage control section controls a voltage applied to the fluid so that the amount of electric charge induced to a droplet of the fluid which has just been ejected from the fluid-ejecting hole is equal to or less than 90% of the amount of electric charge corresponding to Rayleigh limit of the droplet. In this way, it is possible to prevent (i) discharging caused by the reduction of the surface area of the droplet due to the drying of the ejected droplet, and (ii) the reduction of the vapor pressure due to the electrification of the droplet.

Therefore, it becomes possible to lower the reduction of a drying time (time until all the solution of the droplet is vaporized) of the ejected droplet, so that it is possible to adjust the variation of the size of the dot diameter of a landed droplet.

Moreover, because the drying time of the ejected droplet becomes long, it is possible to reduce the change in the diameter of the droplet, that is, the change in the amount of the droplet, until the droplet lands. On this account, the environmental conditions, such as air resistance, ambient humidity, etc. are even between droplets. Therefore, it becomes possible to improve the positioning accuracy of the droplet, that is, possible to suppress the variation of the droplet when landing.

Furthermore, the drying time of the ejected droplet becomes long. Therefore, even when the diameter of the ejected droplet is about Φ5 μm, that is, even when the diameter of the ejected droplet is very minute, it is possible to land the droplet without drying the droplet.

Therefore, by using the electrostatic attraction fluid jet device arranged as above, it is possible to stably eject minute droplets, and also possible to land the droplet with high accuracy.

The following description explains how the amount of electric charge induced to a droplet of the fluid which has just been ejected from the fluid-ejecting hole is equal to or less than 90% of the amount of electric charge corresponding to Rayleigh limit of the droplet.

That is, in order to solve the above problems, the electrostatic attraction fluid jet device of the present invention ejects a fluid, which is electrified by a voltage application, by an electrostatic attraction in the form of a droplet from a fluid-ejecting hole of a nozzle made of an insulating material, wherein an applied voltage control means which controls a voltage applied to the fluid in the nozzle is included, a diameter of the fluid-ejecting hole of the nozzle is equal to or less than a diameter of the droplet, which has just been ejected, of the fluid, and the applied voltage control means controls a voltage applied to a fluid so that the amount of electric charge, induced to a droplet of the fluid which droplet has just been ejected from the fluid-ejecting hole, is equal to or less than the amount of electric charge corresponding to Rayleigh limit of the droplet which has just been ejected by an electric field whose intensity is maximum at the meniscus.

The applied voltage control means may control a voltage applied to the fluid so that the amount of electric charge, induced to a droplet of the fluid which droplet has just been ejected from the fluid-ejecting hole, is equal to or less than 60% of the amount of electric charge corresponding to Rayleigh limit of the droplet.

Generally, the vapor pressure of the electrified droplet decreases according to the amount of electric charge (electrification amount) generated on the surface of the droplet. Therefore, when the electrification amount is too small, it is not effective to suppress the vaporization. Concretely, when the amount of electric charge is less than 60% of the amount of electric charge corresponding to Rayleigh limit of the droplet, it is not effective to suppress the vaporization.

Therefore, it is preferable that the amount of electric charge induced to the droplet of the fluid which has just been ejected from the fluid-ejecting hole be not less than 60% and not more than 90% of the amount of electric charge corresponding to Rayleigh limit of the droplet.

The following description explains how the amount of electric charge induced to a droplet of the fluid which has just been ejected from the fluid-ejecting hole is equal to or more than 60% of the amount of electric charge corresponding to Rayleigh limit of the droplet.

That is, the applied voltage control means controls a voltage applied to a fluid so that the amount of electric charge, induced to a droplet of the fluid which droplet has just been ejected from the fluid-ejecting hole, is equal to or more than 0.8 times as much as the amount of electric charge corresponding to Rayleigh limit of the droplet which has just been ejected by an electric field whose intensity is maximum at a meniscus of the fluid.

It is preferable that the diameter of the fluid-ejecting hole of the nozzle be equal to or less than Φ5 μm. Further, it is preferable that the diameter of the fluid-ejecting hole of the nozzle be not less than Φ0.2 μm and not more than Φ4 μm.

In this case, by setting the diameter of the fluid-ejecting hole of the nozzle to be equal to or less than Φ5 μm, the electric field intensity is concentrated. Therefore, the electric field is concentrated extremely, and it is possible to increase the maximum electric field intensity. As a result, it is possible to improve the efficiency of electrifying the droplet. Further, in order to improve the efficiency of electrifying the droplet, the diameter of the fluid-ejecting hole of the nozzle is set to be not less than Φ0.2 μm and not more than Φ4 μm. In this case, the electric field is concentrated extremely, and it is possible to increase the maximum electric field intensity. As a result, it becomes possible to stably eject the minute droplet whose diameter is short.

Moreover, the electrostatic attraction fluid jet device of the present invention ejects a fluid, which is electrified by a voltage application, on a printing medium with a speed corresponding to an applied voltage, the fluid being ejected in the form of a droplet by an electrostatic attraction from a fluid-ejecting hole of a nozzle made of an insulating material, wherein an applied voltage control means which controls a voltage applied to the fluid in the nozzle is included, a diameter of the fluid-ejecting hole of the nozzle is equal to or less than Φ8 μm, and the applied voltage control means controls a voltage applied to the fluid so that an average velocity of the fluid, which is ejected and lands on a printing medium, is not less than 10 m/s and not more than 40 m/s.

Therefore, it becomes possible to decrease the size of the electric field, which is conventionally large, by setting the nozzle diameter so that the nozzle diameter is substantially equal to the diameter of the tip portion, where the electric charge is concentrated, of the taylor cone formed for ejecting a fluid whose droplet diameter is shorter than the diameter of the fluid-ejecting hole of the conventional nozzle in the conventional process of the electrostatic attraction of the fluid.

According to the above, it is possible to drastically reduce the voltage required for the movement of the electric charge, that is, the voltage required for applying to the fluid the electric charge required for electrostatically attracting the fluid. On this account, it is not necessary to apply a high voltage of 2,000 V which is conventional necessary. As a result, it is possible to improve safety when a fluid jet device is used.

Moreover, because the diameter of the fluid-ejecting hole of the nozzle is equal to or less than Φ8 μm, the intensity distribution of the electric field concentrates near an ejecting surface of the fluid-ejecting hole. Moreover, the change in the distance between the counter electrode and the fluid-ejecting hole of the nozzle does not influence the intensity distribution of the electric field any more.

Therefore, it is possible to eject the fluid stably without being influenced by (i) the positioning accuracy of the counter electrode and (ii) the variation of the material characteristics or the variation of the thickness of the printing medium.

Moreover, because it is possible to reduce the area of the electric field as described above, it becomes possible to generate a high electric field in a small area. As a result, it becomes possible to form minute droplets. On this account, when the droplet is ink, it becomes possible to realize a high resolution printed image.

Furthermore, because the region where the electric charge is concentrated and the meniscus region of the fluid become the same in size, the amount of time for the electric charge to move in the meniscus region does not influence the response of ejection. As a result, it is possible to improve the velocity of the ejected droplet (print speed when the droplet is ink).

Moreover, because the region where the electric charge is concentrated and the meniscus region of the fluid becomes substantially the same in size, it becomes unnecessary to generate the high electric field in the large meniscus region. Therefore, unlike the conventional inventions, it becomes unnecessary to accurately place the counter electrode in order to generate the high electric field in the large meniscus region. In addition, the dielectric constant and the thickness of the printing medium do not influence the positioning of the counter electrode any more.

Therefore, in the electrostatic attraction fluid jet device, the freedom of the positioning of the counter electrode increases. That is, the freedom of the designing of the electrostatic attraction fluid jet device increases. As a result, it becomes possible to print to a printing medium which is conventionally difficult to use, and possible to realize a fluid jet device which is highly versatile, without being influenced by the dielectric constant or the thickness.

Therefore, according to the electrostatic attraction fluid jet device arranged as above, it is possible to realize a device which has high definition, is safe and is highly versatile.

Here, as the fluid, it is possible to use (i) purified water, (ii) oil, (iii) an ink which is a colored fluid containing dyes or pigments as fine particles, (iv) solution containing wiring materials (conductive fine particles, such as silver, copper, etc.) for forming a circuit substrate, etc.

For example, in the case in which the ink is used as the fluid, it is possible to realize high definition printing. In the case in which the solution containing wiring materials for forming the circuit substrate is used as the fluid, it becomes possible to form a super high definition substrate whose line width of the wiring is very narrow. Therefore, in either case, it is possible to eject the fluid stably.

In addition, the applied voltage control means controls a voltage applied to the fluid so that the average velocity of the ejected droplet, which is ejected and lands on the printing medium, is not less than 10 m/s and not more than 40 m/s. In this way, it is possible to reduce the influence of the drying of the fluid while flying. As a result, it is possible to improve the positioning accuracy of the droplet onto the printing medium, possible to suppress the variation of the dot diameter of the landed droplet, and possible to prevent the generation of the mist of the ejected droplet, the mist generated by the influence of the electric field intensity at the meniscus portion. As a result, it is possible to stably eject droplets.

Here, when the average velocity of the ejected droplet, which is ejected and lands on the printing medium, is less than 10 m/s, the positioning accuracy is bad and the stability of ejection is bad, too. Therefore, the dot diameter of the landed droplet varies. Moreover, when the average velocity of the ejected droplet, which is ejected and lands on the printing medium, is more than 40 m/s, a high voltage is required. Therefore, the electric field intensity is very strong at the meniscus portion, and the generation of the mist of the ejected droplet occurs frequently. Therefore, it is impossible to stably eject droplets.

Therefore, as in the electrostatic attraction fluid jet device arranged as above, the average velocity of the ejected droplet, which is ejected and lands on the printing medium, is not less than 10 m/s and not more than 40 m/s. In this way, it becomes possible to stably eject the droplet. As a result, it is possible to improve the positioning accuracy of the droplet, and also possible to suppress the variation of the dot diameter of the landed droplet.

It is preferable that the diameter of the fluid-ejecting hole of the nozzle be equal to or less than Φ5 μm. Further, it is preferable that the diameter of the fluid-ejecting hole of the nozzle be not less than Φ0.2 μm and not more than Φ4 μm.

In this case, by setting the diameter of the fluid-ejecting hole of the nozzle to be equal to or less than Φ5 μm, the electric field intensity is concentrated. Therefore, the electric field is concentrated extremely, and it is possible to increase the maximum electric field intensity. As a result, it is possible to improve the efficiency of electrifying the droplet. Further, in order to improve the efficiency of electrifying the droplet, the diameter of the fluid-ejecting hole of the nozzle can be set to be not less than Φ0.2 μm and not more than Φ4 μm. In this case, the electric field is concentrated extremely, and it is possible to increase the maximum electric field intensity. As a result, it becomes possible to stably eject the minute droplet whose diameter is short.

Moreover, the electrostatic attraction fluid jet device arranged as above can be realized by the following arrangement.

That is, the electrostatic attraction fluid jet device of the present invention ejects a fluid, which is electrified by a voltage application, on a printing medium with a speed corresponding to an applied voltage, the fluid being ejected in the form of a droplet by an electrostatic attraction from a fluid-ejecting hole of a nozzle made of an insulating material, wherein an applied voltage control means which controls a voltage applied to the fluid in the nozzle is included, a diameter of the fluid-ejecting hole of the nozzle is equal to or less than a diameter of the droplet, which has just been ejected, of the fluid, and the applied voltage control means controls a voltage applied to the fluid so that an average velocity of the fluid, which is ejected and lands on a printing medium, is not less than 10 m/s and not more than 40 m/s.

Further, the electrostatic attraction fluid jet device of the present invention ejects a fluid, which contains fine particles and is electrified by a voltage application, by an electrostatic attraction in the form of a droplet from a fluid-ejecting hole of a nozzle made of an insulating material, wherein a diameter of the fluid-ejecting hole of the nozzle is equal to or less than Φ8 μm, and a particle diameter of each of the fine particles contained in the fluid is equal to or less than Φ30 nm.

According to the above arrangement, it becomes possible to decrease the size of the electric field, which is conventionally large, by setting the nozzle diameter so that the nozzle diameter is substantially equal to the diameter of the tip portion, where the electric charge is concentrated, of the taylor cone formed for ejecting a fluid whose droplet diameter is shorter than the diameter of the fluid-ejecting hole of the conventional nozzle in the conventional process of the electrostatic attraction of the fluid.

According to the above, it is possible to drastically reduce the voltage required for the movement of the electric charge, that is, it is possible to reduce the amount of voltage required for electrostatically attracting the fluid. On this account, it is not necessary to apply a high voltage of 2,000 V which is conventional necessary. As a result, it is possible to improve safety when a fluid jet device is used.

Moreover, because the diameter of the fluid-ejecting hole of the nozzle is equal to or less than Φ8 μm, the intensity distribution of the electric field concentrates near an ejecting surface of the fluid-ejecting hole. Moreover, the change in the distance between the counter electrode and the fluid-ejecting hole of the nozzle does not influence the intensity distribution of the electric field any more.

Therefore, it is possible to eject the fluid stably without being influenced by (i) the positioning accuracy of the counter electrode and (ii) the variation of the material characteristics or the variation of the thickness of the printing medium.

Moreover, because it is possible to reduce the area of the electric field as described above, it becomes possible to generate a high electric field in a small area. As a result, it becomes possible to form minute droplets. On this account, when the droplet is ink, it becomes possible to realize a high resolution printed image.

Furthermore, because the region where the electric charge is concentrated and the meniscus region of the fluid become the same in size, the amount of time for the electric charge to move in the meniscus region does not influence the response of ejection. As a result, it is possible to improve the velocity of the ejected droplet (print speed when the droplet is an ink).

Moreover, because the region where the electric charge is concentrated and the meniscus region of the fluid becomes substantially the same in size, it becomes unnecessary to generate the high electric field in the large meniscus region. Therefore, unlike the conventional inventions, it becomes unnecessary to accurately place the counter electrode in order to generate the high electric field in the large meniscus region. In addition, the dielectric constant and the thickness of the printing medium do not influence the positioning of the counter electrode any more.

Therefore, in the electrostatic attraction fluid jet device, the freedom of the positioning of the counter electrode increases. That is, the freedom of the designing of the electrostatic attraction fluid jet device increases. As a result, it becomes possible to print to a printing medium which is conventionally difficult to use, and possible to realize a fluid jet device which is highly versatile, without being influenced by the dielectric constant or the thickness.

Therefore, according to the electrostatic attraction fluid jet device arranged as above, it is possible to realize a device which has high definition, is safe and is highly versatile.

Here, as the fluid, it is possible to use (i) purified water, (ii) oil, (iii) an ink which is a colored fluid containing dyes or pigments as fine particles, (iv) solution containing wiring materials (conductive fine particles, such as silver, copper, etc.) for forming a circuit substrate, etc.

For example, in the case in which the ink is used as the fluid, it is possible to realize high definition printing. In the case in which the solution containing wiring materials for forming the circuit substrate is used as the fluid, it becomes possible to form a super high definition substrate whose line width of the wiring is very narrow. Therefore, in either case, it is possible to eject the fluid stably.

In addition, because the particle diameter of the fine particle contained in the fluid is equal to or less than Φ30 nm, it is possible to reduce the influence of the electrified fine particle to the fine particle itself. Therefore, even when a droplet contains fine particles, it is possible to stably eject the droplet.

Moreover, it is possible to reduce the influence of the electrified fine particle to the fine particle itself. Therefore, unlike the conventional case in which the fluid is ejected by utilizing the electrification of the fine particles, the movement of the fine particle does not become slow when the particle diameter is short. Therefore, the recording velocity does not become low even when the fluid, such as an ink, contains fine particles.

Moreover, it is preferable that the particle diameter of the fine particle contained in the fluid be not less than Φ1 nm and not more than Φ10 nm.

Further, the diameter of the fluid-ejecting hole of the nozzle may be not less than Φ0.2 μm and not more than Φ4 μm.

In this case, because the diameter of the fluid-ejecting hole of the nozzle is set to be not less than Φ0.2 μm and not more than Φ4 μm, the electric field is concentrated extremely. Therefore, it is possible to increase the maximum electric field intensity. As a result, it becomes possible to stably eject a minute droplet whose diameter is short.

Moreover, the electrostatic attraction fluid jet device arranged as above can be realized by the following arrangement.

That is, the electrostatic attraction fluid jet device of the present invention ejects a fluid, which contains fine particles and is electrified by a voltage application, by an electrostatic attraction in the form of a droplet from a fluid-ejecting hole of a nozzle made of an insulating material, wherein a diameter of the fluid-ejecting hole of the nozzle is equal to or less than a diameter of the droplet, which has just been ejected, of the fluid, and a particle diameter of each of the fine particles contained in the fluid is equal to or less than Φ30 nm.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The electrostatic attraction fluid jet device of the present invention can be applied to an ink jet head which ejects ink as a fluid so as to carry out the printing. Moreover, when using a conductive fluid as a fluid, the electrostatic attraction fluid jet device of the present invention can be applied to a device for producing circuit substrates each of which requires minute wirings. Further, in addition to the use for forming wirings, the electrostatic attraction fluid jet device of the present invention can be applied to all kinds of uses for the printing, image formation, patterning of biological materials, such as protein, DNA, etc., combinatorial chemistry, a color filter, an organic EL (Electroluminescence), FED (patterning of carbon nanotube), and patterning of ceramics.

The invention claimed is:

1. An electrostatic attraction fluid jet device which ejects a fluid, which is electrified by a voltage application, by an electrostatic attraction in the form of a droplet from a fluid-ejecting hole of a nozzle made of an insulating material, wherein a diameter of the fluid-ejecting hole of the nozzle is equal to or less than Φ8 μm comprising:

an applied voltage control means which controls a voltage applied to the fluid so as to adjust the amount of the droplet ejected from the fluid-ejecting hole, the applied voltage control means controlling the voltage applied to the fluid so that the amount of the droplet, which has just been ejected from the fluid-ejecting hole, of the fluid is equal to or less than 1 pl, and wherein an amount of electric charge induced to the droplet is equal to or less than 90% of an amount of electric charge corresponding to a Rayleigh limit of the droplet.

2. The electrostatic attraction fluid jet device as set forth in claim 1, wherein the applied voltage control means controls a voltage applied to the fluid so that a diameter of the droplet, which has just been ejected from the fluid-ejecting hole, is not less than 1.5 times and not more than 3 times longer than the diameter of the fluid-ejecting hole.

3. The electrostatic attraction fluid jet device as set forth in claim 1, wherein the applied voltage control means controls a voltage applied to the fluid so that a diameter of the droplet, which has just been ejected from the fluid-ejecting hole, is not less than 1.5 times and not more than twice longer than the diameter of the fluid-ejecting hole.

4. An electrostatic attraction fluid jet device which ejects a fluid, which is electrified by a voltage application, by an electrostatic attraction in the form of a droplet from a fluid-ejecting hole of a nozzle made of an insulating material, comprising:

an applied voltage control means which controls a voltage applied to the fluid so as to adjust the amount of the droplet ejected from the fluid-ejecting hole, and the applied voltage control means controlling the voltage applied to the fluid so that the amount of the droplet, which has just been ejected from the fluid-ejecting hole, of the fluid is equal to or less than 1 pl.

wherein a diameter of the fluid-ejecting hole of the nozzle is equal to or less than a diameter of the droplet, which has just been ejected, of the fluid, and wherein an amount of electric charge induced to the droplet is equal to or less than 90% of an amount of electric charge corresponding to a Rayleigh limit of the droplet.

5. The electrostatic attraction fluid jet device as set forth in claim 4, wherein the diameter of the fluid-ejecting hole of the nozzle is not less than Φ0.2 μm and not more than Φ4 μm.

6. The electrostatic attraction fluid jet device as set forth in claim 4, wherein the applied voltage control means controls a voltage applied to the fluid so that a diameter of the droplet, which has just been ejected from the fluid-ejecting hole, is not less than 1.5 times and not more than twice longer than the diameter of the fluid-ejecting hole.

7. The electrostatic attraction fluid jet device as set forth in claim 4, wherein the applied voltage control means controls a voltage applied to the fluid so that a diameter of the droplet, which has just been ejected from the fluid-ejecting hole, is not less than 1.5 times and mot more than twice longer than the diameter of the fluid-ejecting hole.

8. An electrostatic attraction fluid jet device which ejects a fluid, which is electrified by a voltage application, by an electrostatic attraction in the form of a droplet from a fluid-ejecting hole of a nozzle made of an insulating material, comprising:

an applied voltage control means which controls a voltage applied to the fluid in the nozzle, wherein, a diameter of the fluid-ejecting hole of the nozzle is equal to or less than Φ8 μm, and the applied voltage control means controls a voltage applied to the fluid so that an amount of electric charge, induced to the droplet of the fluid which droplet has just been ejected from the fluid-ejecting hole, is equal to or less than 90% of the amount of electric charge corresponding to Rayleigh limit of the droplet.

9. The electrostatic attraction fluid jet device as set forth in claim 8, wherein the applied voltage control means controls a voltage applied to the fluid so that the amount of electric charge, induced to the droplet of the fluid, the droplet having just been ejected from the fluid-ejecting hole, is equal to or less than 60% of the amount of electric charge corresponding to Rayleigh limit of the droplet.

10. The electrostatic attraction fluid jet device as set forth in claim 8, wherein the diameter of the fluid-ejecting hole of the nozzle is equal to or less than Φ5 μm.

11. The electrostatic attraction fluid jet device as set forth in claim 8, wherein the diameter of the fluid-ejecting hole of the nozzle is not less than Φ0.2 μm and not more than Φ4 μm.

12. An electrostatic attraction fluid jet device which ejects a fluid, which is electrified by a voltage application, by an electrostatic attraction in the form of a droplet from a fluid-ejecting hole of a nozzle made of an insulating material, comprising:

an applied voltage control means which controls a voltage applied to the fluid in the nozzle, wherein a diameter of the fluid-ejecting hole of the nozzle is equal to or less than a diameter of the droplet, which has just been ejected, of the fluid, and the applied voltage control means controls a voltage applied to a fluid so that an amount of electric charge, induced to a droplet of the fluid which droplet has just been ejected from the fluid-ejecting hole, is equal to or less than the amount of electric charge corresponding to Rayleigh limit of the droplet which has just been ejected by an electric field whose intensity is maximum at the meniscus.

13. The electrostatic attraction fluid jet device as set forth in claim 12, wherein the applied voltage control means controls a voltage applied to a fluid so that the amount of electric charge, induced to a droplet of the fluid which droplet has just been ejected from the fluid-ejecting hole, is equal to or 0.8 times as much as the amount of electric charge corresponding to Rayleigh limit of the droplet which has just been ejected by an electric field whose intensity is maximum at a meniscus of the fluid.

14. The electrostatic attraction fluid jet device as set forth in claim 12, wherein the diameter of the fluid-ejecting hole of the nozzle is equal to or less than Φ5 μm.

15. The electrostatic attraction fluid jet device as set forth in claim 12, wherein the diameter of the fluid-ejecting hole of the nozzle is not less than Φ0.2 μm and not more than Φ4 μm.

16. An electrostatic attraction fluid jet device which ejects a fluid, which is electrified by a voltage application, on a printing medium with a speed corresponding to an applied voltage, the fluid being ejected in the form of a droplet by an electrostatic attraction from a fluid-ejecting hole of a nozzle made of an insulating material, comprising:

an applied voltage control means which controls a voltage applied to the fluid in the nozzle, wherein a diameter of the fluid-ejecting hole of the nozzle is equal to or less than Φ8 μm, and the applied voltage control means controls a voltage applied to the fluid so that an average velocity of the fluid, which is ejected and lands on a printing medium, is not less than 10 m/s and not more than 40 m/s.

17. The electrostatic attraction fluid jet device as set forth in claim 16, wherein the diameter of the fluid-ejecting hole of the nozzle is equal to or less than Φ5 μm.

18. The electrostatic attraction fluid jet device as set forth in claim 16, wherein the diameter of the fluid-ejecting hole of the nozzle is not less than Φ0.2 μm and not more than Φ4 μm.

19. An electrostatic attraction fluid jet device which ejects a fluid, which is electrified by a voltage application, on a printing medium with a speed corresponding to an applied voltage, the fluid being ejected in the form of a droplet by an electrostatic attraction from a fluid-ejecting hole of a nozzle made of an insulating material, comprising:

an applied voltage control means which controls a voltage applied to the fluid in the nozzle, wherein a diameter of the fluid-ejecting hole of the nozzle is equal to or less than a diameter of the droplet, which has just been ejected, of the fluid, and the applied voltage control means controls a voltage applied to the fluid so that an average velocity of the fluid, which is ejected and lands on a printing medium, is not less than 10 m/s and not more than 40 m/s.

20. The electrostatic attraction fluid jet device as set forth in claim 19, wherein the diameter of the fluid-ejecting hole of the nozzle is equal to or less than Φ5 μm.

21. The electrostatic attraction fluid jet device as set forth in claim 19, wherein the diameter of the fluid-ejecting hole of the nozzle is not less than Φ0.2 μm and not more than Φ4 μm.

22. An electrostatic attraction fluid jet device which ejects a fluid, which contains fine particles and is electrified by a voltage application, by an electrostatic attraction in the form of a droplet from a fluid-ejecting hole of a nozzle made of an insulating material, wherein a diameter of the fluid-ejecting hole of the nozzle is equal to or less than 8 μm, and a particle diameter of each of the fine particles contained in the fluid is equal to or less than Φ30 nm.

23. The electrostatic attraction fluid jet device as set forth in claim 22, wherein the particle diameter of each of the fine particles contained in the fluid is not less than Φ1 nm and not more than Φ10 nm.

24. The electrostatic attraction fluid jet device as set forth in claim 22, wherein the diameter of the fluid-ejecting hole of the nozzle is not less than Φ0.2 μm and not more than Φ4 μm.

25. An electrostatic attraction fluid jet device which ejects a fluid, which contains fine particles and is electrified by a voltage application, by an electrostatic attraction in the form of a droplet from a fluid-ejecting hole of a nozzle made of an insulating material, wherein a diameter of the fluid-ejecting hole of the nozzle is equal to or less than a diameter of the droplet, which has just been ejected, of the fluid, and a particle diameter of each of the fine particles contained in the fluid is equal to or less than Φ30 nm.

26. The electrostatic attraction fluid jet device as set forth in claim 25, wherein the particle diameter of each of the fine particles contained in the fluid is not less than Φ1 nm and not more than Φ10 nm.

27. The electrostatic attraction fluid jet device as set forth in claim 25, wherein the diameter of the fluid-ejecting hole of the nozzle is not less than Φ0.2 μm and not more than Φ4 μm.

28. An electrostatic attraction fluid jet device which ejects a fluid, which is electrified by a voltage application, by an electrostatic attraction in the form of a droplet from a fluid-ejecting hole of a nozzle made of an insulating material, in the electrostatic attraction fluid jet device, a diameter of the fluid-ejecting hole of the nozzle being equal to or less than a diameter of the droplet, which has just been ejected, of the fluid, the electrostatic attraction fluid jet device comprising:

an electrode for applying a voltage to the fluid; and a process control section for controlling a voltage applied to the electrode so as to adjust the amount of a droplet ejected from the fluid-ejecting hole, the process control section controlling a voltage applied to the electrode so that the amount of a droplet, which has just been ejected from the fluid-ejecting hole, of the fluid is less than 1 pl, and wherein an amount of electric charge induced to the droplet is equal to or less than 90% of an amount of electric charge corresponding to a Rayleigh limit of the droplet.

29. An electrostatic attraction fluid jet device which ejects a fluid, which is electrified by a voltage application, by an electrostatic attraction in the form of a droplet from a fluid-ejecting hole of a nozzle made of an insulating material, in the electrostatic attraction fluid jet device, a diameter of the fluid-ejecting hole of the nozzle being equal to or less than Φ8 μm, the electrostatic attraction fluid jet device comprising:

an electrode for applying a voltage to the fluid; and a process control section for controlling a voltage applied to the electrode so as to adjust the amount of a droplet ejected from the fluid-ejecting hole, the process control section controlling a voltage applied to the electrode so that the amount of a droplet, which has just been ejected from the fluid-ejecting hole, of the fluid is less than 1 pl, and wherein an amount of electric charge induced to the droplet is equal to or less than 90% of an amount of electric charge corresponding to a Rayleigh limit of the droplet.

30. An electrostatic attraction fluid jet device which ejects a fluid, which is electrified by a voltage application, by an electrostatic attraction in the form of a droplet from a fluid-ejecting hole of a nozzle made of an insulating material, in the electrostatic attraction fluid jet device, a diameter of the fluid-ejecting hole of the nozzle being equal to or less than Φ8 μm, the electrostatic attraction fluid jet device comprising:

an electrode for applying a voltage to the fluid; and a process control section for controlling a voltage applied to the electrode so as to adjust the amount of a droplet ejected from the fluid-ejecting hole, the process control section controlling a voltage applied to the electrode so that an amount of electric charge, induced to a droplet of the fluid which droplet has just been ejected from the fluid-ejecting hole, is equal to or less than 90% of the amount of electric charge corresponding to Rayleigh limit of the droplet.

31. An electrostatic attraction fluid jet device which ejects a fluid, which is electrified by a voltage application, by an electrostatic attraction in the form of a droplet from a fluid-ejecting hole of a nozzle made of an insulating material, in the electrostatic attraction fluid jet device, a diameter of the fluid-ejecting hole of the nozzle being equal to or less than a diameter of the droplet, which has just been ejected, of the fluid, the electrostatic attraction fluid jet device comprising:

an electrode for applying a voltage to the fluid; and a process control section for controlling a voltage applied to the electrode so as to adjust the amount of a droplet ejected from the fluid-ejecting hole, the process control section controlling a voltage applied to the electrode so that an amount of electric charge, induced to a droplet of the fluid which droplet has just been ejected from the fluid-ejecting hole, is equal to or less than the amount of electric charge corresponding to Rayleigh limit of the droplet which has just been ejected by an electric field whose intensity is maximum at the meniscus.

32. An electrostatic attraction fluid jet device which ejects a fluid, which is electrified by a voltage application, on a printing medium with a speed corresponding to an applied voltage, the fluid being ejected in the form of a droplet by an electrostatic attraction from a fluid-ejecting hole of a nozzle made of an insulating material, in the electrostatic attraction fluid jet device, a diameter of the fluid-ejecting hole of the nozzle being equal to or less than Φ8 μm, the electrostatic attraction fluid jet device comprising:

an electrode for applying a voltage to the fluid; and a process control section for controlling a voltage applied to the electrode so as to adjust the amount of a droplet ejected from the fluid-ejecting hole, the process control section controlling a voltage applied to the electrode so that an average velocity of the fluid, which is ejected and lands on a printing medium, is not less than 10 m/s and not more than 40 m/s.

33. An electrostatic attraction fluid jet device which ejects a fluid, which is electrified by a voltage application, on a printing medium with a speed corresponding to an applied voltage, the fluid being ejected in the form of a droplet by an electrostatic attraction from a fluid-ejecting hole of a nozzle made of an insulating material, in the electrostatic attraction fluid jet device, a diameter of the fluid-ejecting hole of the nozzle being equal to or less than a diameter of the droplet, which has just been ejected, of the fluid, the electrostatic attraction fluid jet device comprising:

an electrode for applying a voltage to the fluid; and a process control section for controlling a voltage applied to the electrode so as to adjust the amount of a droplet ejected from the fluid-ejecting hole, the process control section controlling a voltage applied to the electrode so that an average velocity of the fluid, which is ejected and lands on a printing medium, is not less than 10 m/s and not more than 40 m/s.

34. An electrostatic attraction ink jet device which ejects ink, which is electrified by a voltage application, by an electrostatic attraction in the form of a droplet from an ink-ejecting hole of a nozzle made of an insulating material, comprising:

an applied voltage control means which controls a voltage applied to the fluid so as to adjust the amount of the droplet ejected from the fluid-ejecting hole; and the applied voltage control means controlling the voltage applied to the fluid so that the amount of the droplet, which has just been ejected from the fluid-ejecting hole, of the fluid is equal to or less than 1 pl, wherein a diameter of the ink-ejecting hole of the nozzle is equal to or less than a diameter of the droplet of the ink which has just been ejected, and wherein an amount of electric charge induced to the droplet is equal to or less than 90% of an amount of electric charge corresponding to a Rayleigh limit of the droplet. wherein a diameter of the ink-ejecting hole of the nozzle is equal to or less than a diameter of the droplet of the ink which has just been ejected.

* * * * *